US008331836B2

(12) United States Patent
Kamekura et al.

(10) Patent No.: US 8,331,836 B2
(45) Date of Patent: Dec. 11, 2012

(54) IMAGE FORMING APPARATUS, IMAGE FORMING METHOD, AND PROGRAM

(75) Inventors: Takahiro Kamekura, Kanagawa (JP); Takashi Enami, Kanagawa (JP); Nobuyuki Kobayashi, Kanagawa (JP); Shigeyuki Ishii, Kanagawa (JP); Jun Kosako, Kanagawa (JP); Natsuko Kawase, Kanagawa (JP); Takahiro Miyakawa, Kanagawa (JP); Miyo Taniguchi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 274 days.

(21) Appl. No.: 12/780,346

(22) Filed: May 14, 2010

(65) Prior Publication Data

US 2010/0303512 A1 Dec. 2, 2010

(30) Foreign Application Priority Data

May 26, 2009 (JP) ..... 2009-126757

(51) Int. Cl.
*G03G 15/01* (2006.01)

(52) U.S. Cl. ..... 399/301; 399/9; 399/66; 399/121; 399/395

(58) Field of Classification Search ..... 399/9, 38, 399/66, 72, 75, 121, 297, 299–302, 308, 399/394, 395
See application file for complete search history.

(56) References Cited

U.S. PATENT DOCUMENTS

2007/0116497 A1* 5/2007 Yamazaki ..... 399/299

FOREIGN PATENT DOCUMENTS

| | | |
|---|---|---|
| JP | 2001-175091 | 6/2001 |
| JP | 2004-205943 | 7/2004 |
| JP | 2006-126643 | 5/2006 |
| JP | 4042127 | 11/2007 |

OTHER PUBLICATIONS

U.S. Appl. No. 12/708,901, filed Feb. 19, 2010, Kosako, et al.
U.S. Appl. No. 12/787,678, filed May 26, 2010, Enami, et al.

* cited by examiner

*Primary Examiner* — Walter L Lindsay, Jr.
*Assistant Examiner* — Roy Y Yi
(74) *Attorney, Agent, or Firm* — Oblon, Spivak, McClelland, Maier & Neustadt, L.L.P.

(57) ABSTRACT

A first alignment control unit causes a secondary transfer control unit to bring a transfer-sheet conveying belt and an intermediate transfer belt into contact with each other so as to transfer an alignment control pattern formed on the transfer-sheet conveying belt onto the intermediate transfer belt, whereby alignment for colors C and K is performed on the intermediate transfer belt, and furthermore a second alignment control unit causes the secondary transfer control unit to separate the transfer-sheet conveying belt and the intermediate transfer belt from each other so as to perform alignment for colors Y, M, and C, whereby alignment is performed for all the colors.

15 Claims, 15 Drawing Sheets

FIG. 11

| | |
|---|---|
| PRINT MODE | FULL COLOR |
| K PHOTOSENSITIVE ELEMENT | PRINT |
| M PHOTOSENSITIVE ELEMENT | PRINT |
| C PHOTOSENSITIVE ELEMENT | PRINT |
| Y PHOTOSENSITIVE ELEMENT | PRINT |
| SECONDARY TRANSFER ROLLER | CONTACT |

FIG. 12

| | |
|---|---|
| PRINT MODE | BLACK-AND-WHITE |
| K PHOTOSENSITIVE ELEMENT | PRINT |
| M PHOTOSENSITIVE ELEMENT | STOP |
| C PHOTOSENSITIVE ELEMENT | STOP |
| Y PHOTOSENSITIVE ELEMENT | STOP |
| SECONDARY TRANSFER ROLLER | SEPARATION |

FIG. 13

| | |
|---|---|
| K PHOTOSENSITIVE ELEMENT | FIRST ALIGNMENT |
| M PHOTOSENSITIVE ELEMENT | RUN IDLE |
| C PHOTOSENSITIVE ELEMENT | FIRST ALIGNMENT |
| Y PHOTOSENSITIVE ELEMENT | RUN IDLE |
| SECONDARY TRANSFER ROLLER | CONTACT |

FIG. 14

| | |
|---|---|
| K PHOTOSENSITIVE ELEMENT | STOP |
| M PHOTOSENSITIVE ELEMENT | SECOND ALIGNMENT |
| C PHOTOSENSITIVE ELEMENT | SECOND ALIGNMENT |
| Y PHOTOSENSITIVE ELEMENT | SECOND ALIGNMENT |
| SECONDARY TRANSFER ROLLER | SEPARATION |

FIG. 15

| | |
|---|---|
| PRINT MODE | BLACK-AND-WHITE |
| K PHOTOSENSITIVE ELEMENT | PRINT |
| M PHOTOSENSITIVE ELEMENT | SECOND ALIGNMENT |
| C PHOTOSENSITIVE ELEMENT | SECOND ALIGNMENT |
| Y PHOTOSENSITIVE ELEMENT | SECOND ALIGNMENT |
| SECONDARY TRANSFER ROLLER | SEPARATION |

FIG. 16

| | | | |
|---|---|---|---|
| PRINT MODE | STANDBY | BLACK-AND-WHITE | FULL COLOR |
| K PHOTOSENSITIVE ELEMENT | FIRST ALIGNMENT | PRINT | PRINT |
| M PHOTOSENSITIVE ELEMENT | RUN IDLE | SECOND ALIGNMENT | PRINT |
| C PHOTOSENSITIVE ELEMENT | FIRST ALIGNMENT | SECOND ALIGNMENT | PRINT |
| Y PHOTOSENSITIVE ELEMENT | RUN IDLE | SECOND ALIGNMENT | PRINT |
| SECONDARY TRANSFER ROLLER | CONTACT | SEPARATION | CONTACT |

TIME →

FIG. 17

| | | | |
|---|---|---|---|
| PRINT MODE | STANDBY | BLACK-AND-WHITE | STOP |
| K PHOTOSENSITIVE ELEMENT | FIRST ALIGNMENT | PRINT | STOP |
| M PHOTOSENSITIVE ELEMENT | RUN IDLE | SECOND ALIGNMENT | |
| C PHOTOSENSITIVE ELEMENT | FIRST ALIGNMENT | SECOND ALIGNMENT | |
| Y PHOTOSENSITIVE ELEMENT | RUN IDLE | SECOND ALIGNMENT | |
| SECONDARY TRANSFER ROLLER | CONTACT | SEPARATION | |

TIME →

FIG. 18

| | | | |
|---|---|---|---|
| PRINT MODE | BLACK-AND-WHITE | STANDBY | FULL COLOR |
| K PHOTOSENSITIVE ELEMENT | PRINT | FIRST ALIGNMENT | PRINT |
| M PHOTOSENSITIVE ELEMENT | SECOND ALIGNMENT | RUN IDLE | PRINT |
| C PHOTOSENSITIVE ELEMENT | SECOND ALIGNMENT | FIRST ALIGNMENT | PRINT |
| Y PHOTOSENSITIVE ELEMENT | SECOND ALIGNMENT | RUN IDLE | PRINT |
| SECONDARY TRANSFER ROLLER | SEPARATION | CONTACT | |

TIME →

FIG. 19

| | | | |
|---|---|---|---|
| PRINT MODE | FULL COLOR | STOP | |
| K PHOTOSENSITIVE ELEMENT | PRINT | FIRST ALIGNMENT | STOP |
| M PHOTOSENSITIVE ELEMENT | PRINT | RUN IDLE | SECOND ALIGNMENT |
| C PHOTOSENSITIVE ELEMENT | PRINT | FIRST ALIGNMENT | SECOND ALIGNMENT |
| Y PHOTOSENSITIVE ELEMENT | PRINT | RUN IDLE | SECOND ALIGNMENT |
| SECONDARY TRANSFER ROLLER | CONTACT | | SEPARATION |

TIME →

FIG. 20

| | | | | |
|---|---|---|---|---|
| PRINT MODE | FULL COLOR | STANDBY | BLACK-AND-WHITE | STOP |
| K PHOTOSENSITIVE ELEMENT | PRINT | FIRST ALIGNMENT | PRINT | STOP |
| M PHOTOSENSITIVE ELEMENT | PRINT | RUN IDLE | SECOND ALIGNMENT | |
| C PHOTOSENSITIVE ELEMENT | PRINT | FIRST ALIGNMENT | SECOND ALIGNMENT | |
| Y PHOTOSENSITIVE ELEMENT | PRINT | RUN IDLE | SECOND ALIGNMENT | |
| SECONDARY TRANSFER ROLLER | CONTACT | | SEPARATION | |

TIME →

FIG. 21

| | | | | | |
|---|---|---|---|---|---|
| PRINT MODE | FULL COLOR | STANDBY | BLACK-AND-WHITE | STOP | BLACK-AND-WHITE |
| K PHOTOSENSITIVE ELEMENT | PRINT | FIRST ALIGNMENT | PRINT | STOP | PRINT |
| M PHOTOSENSITIVE ELEMENT | PRINT | RUN IDLE | SECOND ALIGNMENT | | |
| C PHOTOSENSITIVE ELEMENT | PRINT | FIRST ALIGNMENT | SECOND ALIGNMENT | | |
| Y PHOTOSENSITIVE ELEMENT | PRINT | RUN IDLE | SECOND ALIGNMENT | | |
| SECONDARY TRANSFER ROLLER | CONTACT | CONTACT | SEPARATION | | |

TIME →

IMAGE FORMING APPARATUS, IMAGE FORMING METHOD, AND PROGRAM

CROSS-REFERENCE TO RELATED APPLICATIONS

The present application claims priority to and incorporates by reference the entire contents of Japanese Patent Application No. 2009-126757 filed in Japan on May 26, 2009.

BACKGROUND OF THE INVENTION

1. Field of the Invention

The present invention relates to an image forming apparatus, an image forming method, and a program.

2. Description of the Related Art

Nowadays, in accordance with demands of the market, most electrophotographic apparatuses, such as color copiers and color printers, output color images. Especially, in recent years, because speeds as fast as those of black-and-white output are required during color output, mostly used tandem-type image forming apparatuses include a photosensitive element and a developing device for each color so that a single-color toner image is formed on each photosensitive element and the single-color toner image is sequentially transferred, whereby a color image is recorded on a transfer sheet (for example, see Japanese Patent Application Laid-open No. 2006-126643).

In the tandem-type image forming apparatuses, for both a direct transfer method and an indirect transfer method, an image formed on a photosensitive element for each color is transferred onto a transfer sheet or a belt at a different position from that of other colors on an intermediate transfer belt; therefore, when the moving speed of the intermediate transfer belt is slightly changed, the time to reach the transfer position for a subsequent color is changed, whereby the transfer position for each color is shifted and, as a result, misalignment (color deviation) in the sub-scanning direction may occur on the output image.

A write unit is also separately arranged for each color; therefore, when a magnification in the main scanning direction or a write position is changed due to displacement of a component because of a change in the environment such as a temperature change, misalignment in the main scanning direction may occur on the output image as a result.

Therefore, a tandem-type image forming apparatus performs an alignment control process by forming an alignment control pattern image on an intermediate transfer belt between an image processed area of the preceding page and an image processed area of the following page so as to detect misalignment in the main and sub-scanning directions by using the pattern image and to correct the misalignment.

There is a problem in that the above-described alignment control process requires a certain processing time, which results in the occurrence of downtime during which the process is being executed and a print process cannot be performed, which results in a decrease in printing productivity. Moreover, there is a problem in that, if the black-and-white printing, for which the alignment control is not needed, is interrupted by the alignment control process due to a timer setting, or the like, printing productivity is decreased due to the interruption of the black-and-white printing even though the alignment control is not necessary.

Japanese Patent Application Laid-open No. 2006-126643 discloses a technology in which, when a print job is received before the start of an alignment process, a print process is performed without performing the alignment process and, when a print job is received after the start of the alignment process, the alignment process is interrupted and the print process is started, whereby the priority is put on the print job and a decrease in productivity due to the alignment process is prevented.

However, according to the technology disclosed in Japanese Patent Application Laid-open No. 2006-126643, because the print process cannot be performed during the alignment process, the problem of a decrease in printing productivity has not been resolved.

SUMMARY OF THE INVENTION

It is an object of the present invention to at least partially solve the problems in the conventional technology. An image forming apparatus that includes: a direct transfer control unit that controls a single-color image forming unit and a direct transfer unit, wherein the direct transfer control unit is configured to transfer an image formed by the single-color image forming unit onto the direct transfer unit or a transfer sheet conveyed by the direct transfer unit; an indirect transfer control unit that controls multicolor image forming units and an intermediate transfer unit and causes the multicolor image forming units to superimpose multicolor images on the intermediate transfer unit; a secondary transfer control unit that controls proximity and separation between the direct transfer unit and the intermediate transfer unit; a first alignment control unit that performs a first alignment control process by causing the secondary transfer control unit to perform the proximity control so as to transfer both an image formed on the direct transfer unit by the direct transfer control unit and an image formed on the intermediate transfer unit by the indirect transfer control unit onto at least one of the direct transfer unit and the intermediate transfer unit, wherein the first alignment control unit is configured to correct misalignment of each of the images in a main-scanning and a sub-scanning directions; and a second alignment control unit that performs a second alignment control process by causing the secondary transfer control unit to perform a separation control, wherein the second alignment control unit uses a position of a color image that has undergone the first alignment control process as a reference, wherein the second alignment control unit is configured to correct misalignment of a different color image formed on the intermediate transfer unit by the indirect transfer control unit in the main-scanning and sub-scanning directions.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 11 is a diagram that illustrates the operations of each photosensitive element and the secondary transfer roller during the full-color printing;

FIG. 12 is a diagram that illustrates the operations of each photosensitive element and the secondary transfer roller during the black-and-white printing;

FIG. 13 is a diagram that illustrates the operations of each photosensitive element and the secondary transfer roller during the first alignment;

FIG. 14 is a diagram that illustrates the operations of each photosensitive element and the secondary transfer roller during the second alignment;

FIG. 15 is a diagram that illustrates the operations of each photosensitive element and the secondary transfer roller if the second alignment is performed at the same time as the black-and-white printing;

FIG. 16 is a schematic diagram that illustrates an example of a first system control;

FIG. 17 is a schematic diagram that illustrates an example of a second system control;

FIG. 18 is a schematic diagram that illustrates a third system control;

FIG. 19 is a schematic diagram that illustrates an example of a fourth system control;

FIG. 20 is a schematic diagram that illustrates an example of a fifth system control;

FIG. 21 is a schematic diagram that illustrates an example of a sixth system control;

DETAILED DESCRIPTION OF THE PREFERRED EMBODIMENTS

A detailed explanation is given below of preferred embodiments of an image forming apparatus, an image forming method, and a program according to the present invention with reference to the accompanying drawings.

Figure 1:
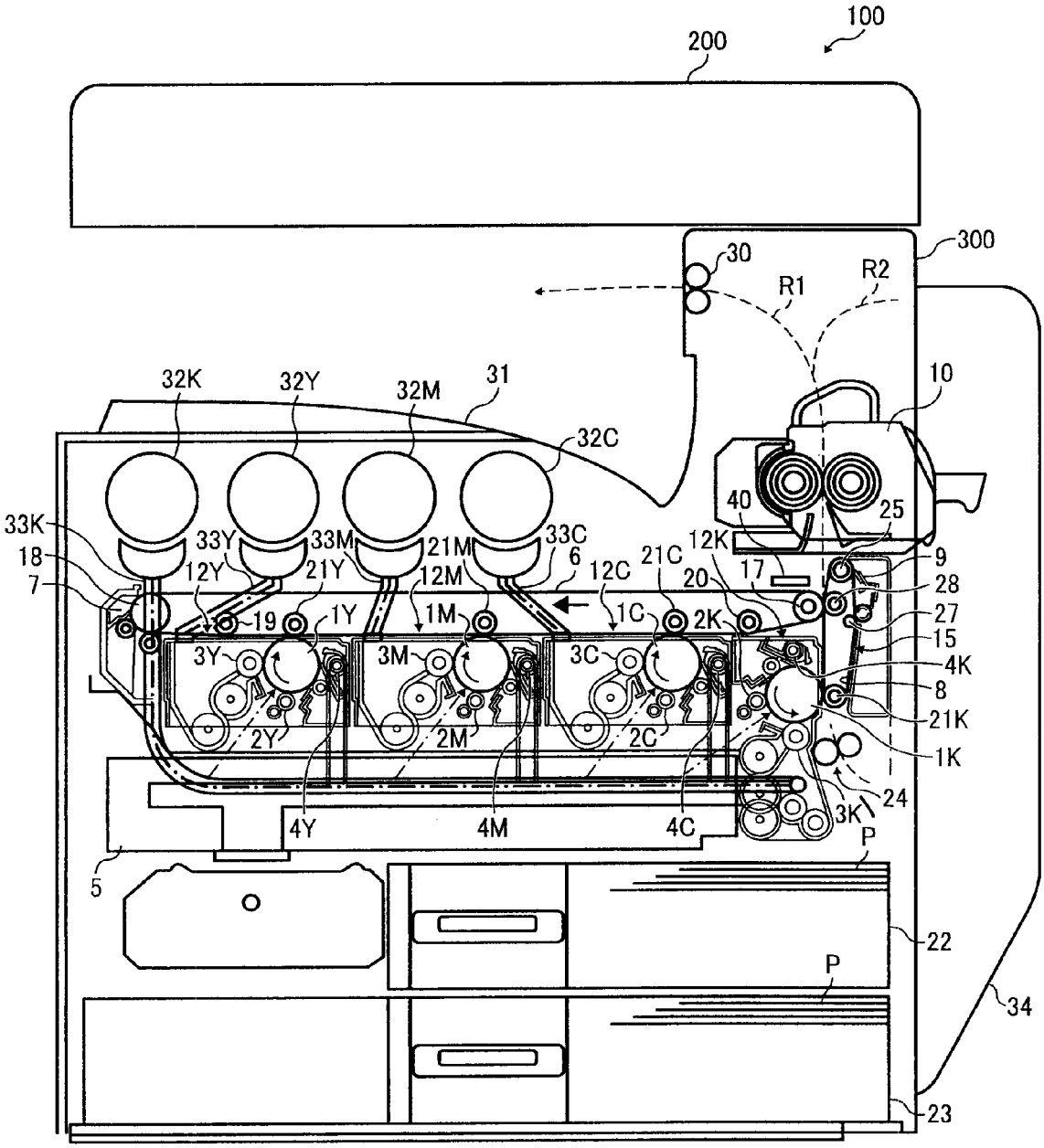
FIG. 1 is a schematic diagram of a color digital MFP (multi function peripheral) according to an embodiment of the present invention.

An explanation is given of an embodiment of the present invention with reference to FIG. 1. In an example according to the present embodiment, a color digital MFP which is called an MFP (multi function peripheral) is applied as an image forming apparatus. The MFP has, in combination, a copy function, a facsimile (FAX) function, a print function, a scanner function, a function for distributing an input image (an image of an original read using a scanner function or an image input using a printer or FAX function), and the like.

FIG. 1 is a schematic diagram of a color digital MFP 100 according to the embodiment of the present invention. As illustrated in FIG. 1, the color digital MFP 100 includes a scanner unit 200 that is an image read apparatus and a printer unit 300 that is an image print apparatus having an electrophotographic system. An engine control unit 500 (see FIG. 3) includes the scanner unit 200 and the printer unit 300. In the color digital MFP 100 according to the present embodiment, a document box function, a copy function, a printer function, and a facsimile function may be sequentially selected by using an application switch key of an operating unit 400 (see FIG. 3). A document box mode is set when the document box function is selected, a copy mode is set when the copy function is selected, a printer mode is set when the printer function is selected, and a facsimile mode is set when the facsimile function is selected.

The printer unit 300 that has the characteristic function of the color digital MFP 100 according to the present embodiment will be explained in detail. As illustrated in FIG. 1, the printer unit 300 in the color digital MFP 100 has a tandem system in which three image forming units 12Y, 12M, and 12C for yellow, magenta, and cyan (hereinafter, abbreviated as Y, M, C) are serially arranged in the belt-moving direction along an intermediate transfer belt 6 that is a looped intermediate transfer unit extending substantially horizontally. The intermediate transfer belt 6 is supported by a drive roller 17, a follower roller 18, and tension rollers 19 and 20. A cleaning unit 7 that removes residual toner from the intermediate transfer belt 6 is located on the outer side of the intermediate transfer belt 6 and is opposed to the follower roller 18.

In addition, in the printer unit 300 of the color digital MFP 100, an image forming unit 12K for black (K) is separately arranged at an upstream position of the tandem arrangement in the moving direction of a transfer sheet (recording medium). The image forming unit 12K for black (K) is arranged such that a toner image formed by the image forming unit 12K for black is directly transferred onto a transfer sheet. Specifically, the image forming unit 12K for black is separate from the transfer structures for colors Y, M, and C that are opposed to the intermediate transfer belt 6, and a black toner image formed thereby is directly transferred onto a transfer sheet by a secondary transfer unit 15 rather than the intermediate transfer belt 6. The secondary transfer unit 15 is arranged such that it substantially vertically intersects with the intermediate transfer belt 6 extending substantially horizontally and is located at a position on the conveying path of a transfer sheet P, where a plurality of color images superimposed on the intermediate transfer belt 6 and a black image transferred onto the transfer sheet P are superimposed. More specifically, the image forming unit 12K for black is located near and along the substantially vertical conveying path of the transfer sheet P, and the secondary transfer unit 15 is located in a space on the upstream side of a fixing device 10 on the substantially vertical conveying path.

Figure 2A:
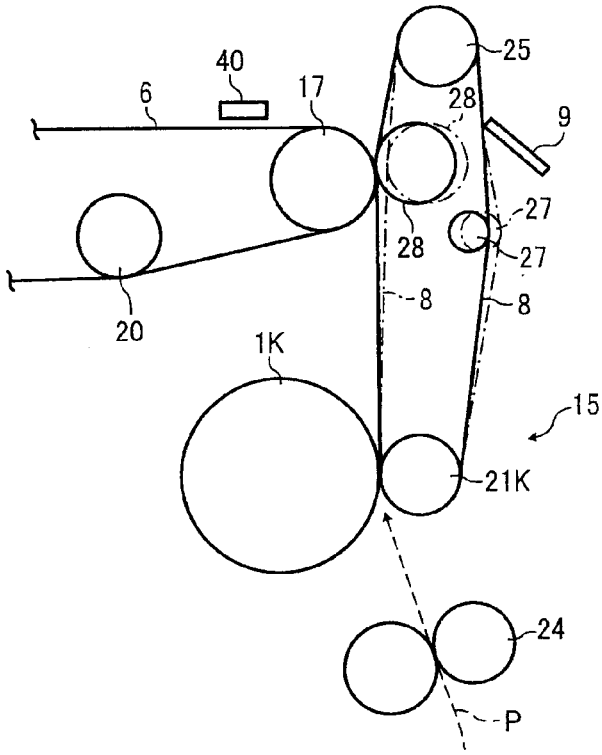
FIG. 2A is a diagram that schematically illustrates the configuration for separating a secondary transfer roller on the direct transfer side from an intermediate transfer belt.

FIG. 2A is a schematic diagram that schematically illustrates the configuration of the secondary transfer unit 15. As illustrated in FIG. 2A, the secondary transfer unit 15 primarily includes a transfer-sheet conveying belt 8 as a direct transfer unit, a drive roller 25 that supports the transfer-sheet conveying belt 8, a follower roller 21K that is also a transfer unit, a tension roller 27, a secondary transfer roller 28 as a secondary transfer unit, and a cleaning device 9 that cleans the transfer-sheet conveying belt 8. The secondary transfer roller 28 is disposed such that it is opposed to the drive roller 17 of the intermediate transfer belt 6. The secondary transfer roller 28 may be disposed as capable of being close to the intermediate transfer belt 6, as indicated by a solid line in the drawing, or may be disposed as capable of being away from the intermediate transfer belt 6, as indicated by a dashed-dotted line in the drawing. The secondary transfer roller 28 may be disposed in such a way as described above by retaining the tension of the transfer-sheet conveying belt 8 with an undepicted contact/separate mechanism and the tension roller 27.

Although the secondary transfer unit 15 according to the present embodiment has a configuration to displace the secondary transfer roller 28, the present invention is not limited thereto and the entire transfer-sheet conveying belt 8 may be displaced by using the follower roller 21K as a supporting point.

A conventional configuration is known that separates an intermediate transfer belt from image carriers for colors, excluding black, during formation of monochrome images. In this system, only the intermediate transfer belt is driven and image forming units for colors, excluding black, do not need to be driven (run idle); however, because the intermediate transfer belt is displaced, the problem of tension variation is inevitable. When a configuration is such that the secondary transfer roller 28 is displaced or the entire transfer-sheet conveying belt 8 is displaced, the transfer-sheet conveying belt 8, which has a much shorter circumferential length than that of the intermediate transfer belt 6, is moved in or away so that the intermediate transfer belt 6 may be left unchanged (does not move together with the transfer-sheet conveying belt 8); therefore, the tension of the intermediate transfer belt 6 does not vary. In other words, a configuration may be such that the intermediate transfer belt 6, for which alignment needs to be performed at many points, is brought into contact with or separated from the transfer-sheet conveying belt 8; however, in this case, there is a possibility that the position accuracy for alignment is decreased over time. Conversely, according to the present embodiment, because a configuration may be such that the intermediate transfer belt 6 is kept in contact with respective photosensitive elements 1 (1Y, 1M, 1C) for colors Y, M, and C, high positioning accuracy may be set between the intermediate transfer belt 6 and the rollers, which improves the allowance for shifting of the belt. Furthermore, because the belt is moved in a stable manner, it is possible to improve the allowance for misalignment during formation of full-color images.

Figure 2B:
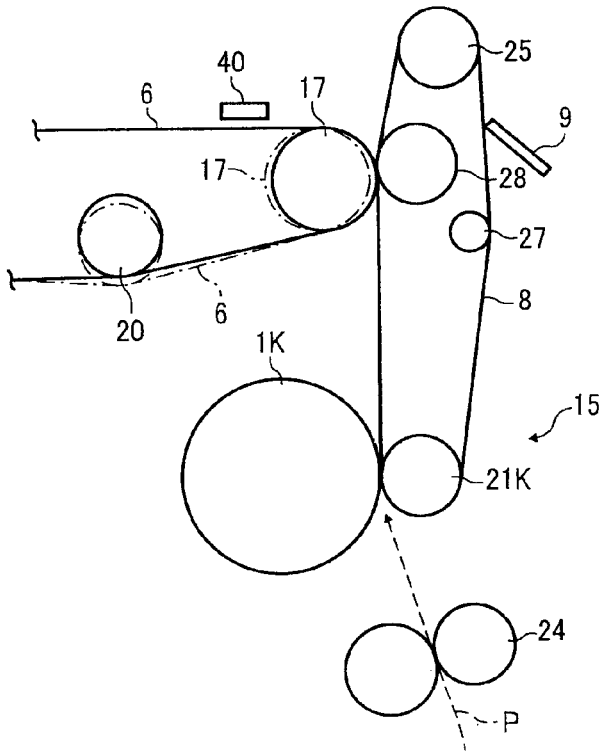
FIG. 2B is a diagram that schematically illustrates the configuration for separating a drive roller on the intermediate transfer side from a transfer-sheet conveying belt.

As illustrated in FIG. 2B, a configuration may be such that the drive roller 17, which supports the intermediate transfer belt 6, is displaced by an undepicted contact/separate mechanism, the tension of the intermediate transfer belt 6 is retained by the tension roller 20, and the intermediate transfer belt 6 is brought into contact with or separated from the transfer-sheet conveying belt 8. In this case, because the conveying posture of the transfer sheet P may not change, the behavior of the transfer sheet P may be prevented from becoming unstable between the transfer-sheet conveying belt 8 and the fixing device 10. Therefore, it is possible to prevent the occurrence of wrinkles or image distortion of the transfer sheet P discharged from the fixing device 10. Furthermore, a configuration may be such that both the secondary transfer roller 28 in the secondary transfer unit 15 and the drive roller 17, which supports the intermediate transfer belt 6, are moved so that the intermediate transfer belt 6 and the transfer-sheet conveying belt 8 are brought into contact with or separated from each other.

Refer back to FIG. 1. Each of the image forming units 12Y, 12M, 12C, and 12K is configured as a process cartridge that is detachably attachable to the main body of the printer unit 300. The image forming unit 12 (12Y, 12M, 12C, 12K) includes the photosensitive element 1 (1Y, 1M, 1C, 1K) that is an image carrier, a charging device 2 (2Y, 2M, 2C, 2K), a developing device 3 (3Y, 3M, 3C, 3K) that feeds toner to a latent image to form a toner image, a cleaning device 4 (4Y, 4M, 4C, 4K), and the like. In the image forming units 12Y, 12M, and 12C, the photosensitive elements 1Y, 1M, and 1C are arranged such that they are in contact with the stretched surface of the lower side of the intermediate transfer belt 6. Primary transfer rollers 21Y, 21C, and 21M are arranged as primary transfer units on the inner side of the intermediate transfer belt 6 such that they are opposed to the photosensitive elements 1 (1Y, 1M, 1C).

The printer unit 300 in the color digital MFP 100 includes an exposure device 5 that emits laser light from an undepicted LD and corresponds to the image forming unit 12 (12Y, 12M, 12C, 12K) for each color. A manuscript read by the scanner unit 200, data received by a facsimile or the like, or color image information transmitted from a computer is subjected to color separation for each of the colors of yellow, cyan, magenta, and black so as to form data on a channel for each color, and the data is then sent to the exposure device 5 in the image forming unit 12 (12Y, 12M, 12C, 12K) for each color. The laser light emitted from the LD of the exposure device 5 forms an electrostatic latent image on the photosensitive element 1 (1Y, 1M, 1C, 1K) of the image forming unit 12 (12Y, 12M, 12C, 12K).

Although the blade-type cleaning devices 4 and 9 are used according to the present embodiment, the present invention is not limited thereto, and a fur-brush roller or a magnetic-brush cleaning system may be used. The exposure device 5 is not limited to a laser system and may be an LED system and the like.

The printer unit 300 in the color digital MFP 100 further includes pattern detection sensors 40 that detect an alignment control pattern 13 (see FIG. 7) formed on the intermediate transfer belt 6 in order to detect skew value, or the like in the scanning of the undepicted LD. The pattern detection sensors 40 are disposed on the extreme left, the middle, and the extreme right of the intermediate transfer belt 6 in its width direction.

When a reflective optical sensor (regular-reflection optical sensor) is used as the pattern detection sensor 40, the intermediate transfer belt 6 is irradiated with light so that the pattern detection sensor 40 detects light reflected by the intermediate transfer belt 6 and the alignment control pattern 13 formed on the intermediate transfer belt 6 so as to obtain information for measuring the misalignment amount.

Although the regular-reflection optical sensor is used as the pattern detection sensor 40, the present invention is not limited thereto and a diffusion optical sensor unit, which reads light diffused by the alignment control pattern 13 and the intermediate transfer belt 6, may be used.

The alignment control function is capable of measuring skew with respect to a reference color, sub-scanning misregistration, main-scanning misregistration, and main-scanning magnification error. For actual reading, an edge portion of the alignment control pattern 13 is read. The details of the alignment control will be described later.

Feed trays 22 and 23 that contain transfer sheets of different sizes are disposed under the printer unit 300 of the color digital MFP 100. The transfer sheet P that is fed from each of the feed trays 22 and 23 by an undepicted feed unit is conveyed to a registration roller pair 24 by an undepicted conveying unit. Then the skew is corrected by the registration roller pair 24 and then the transfer sheet P is conveyed by the registration roller pair 24 to a transfer area between the photosensitive element 1K and the transfer-sheet conveying belt 8 at a predetermined timing.

The printer unit 300 in the color digital MFP 100 further includes a toner bank 32 that is located above the intermediate transfer belt 6. The toner bank 32 includes toner tanks 32K, 32Y, 32C, and 32M, and these toner tanks are connected to the developing devices 3 (3Y, 3M, 3C, 3K) via toner feed pipes 33K, 33Y, 33C, and 33M. Because the image forming unit 12K for black is arranged separately from the image forming units 12 (12Y, 12M, 12C) for colors Y, M, and C, transfer toner for colors Y, M, and C does not get mixed during the process of forming black images. Therefore, toner collected from the photosensitive element 1K is conveyed to the developing device 3K for black via an undepicted black-toner collection path and is then reused. A device that removes paper dust or a device that can switch a path to dispose of toner may be provided along the black-toner collection path.

Figure 3:
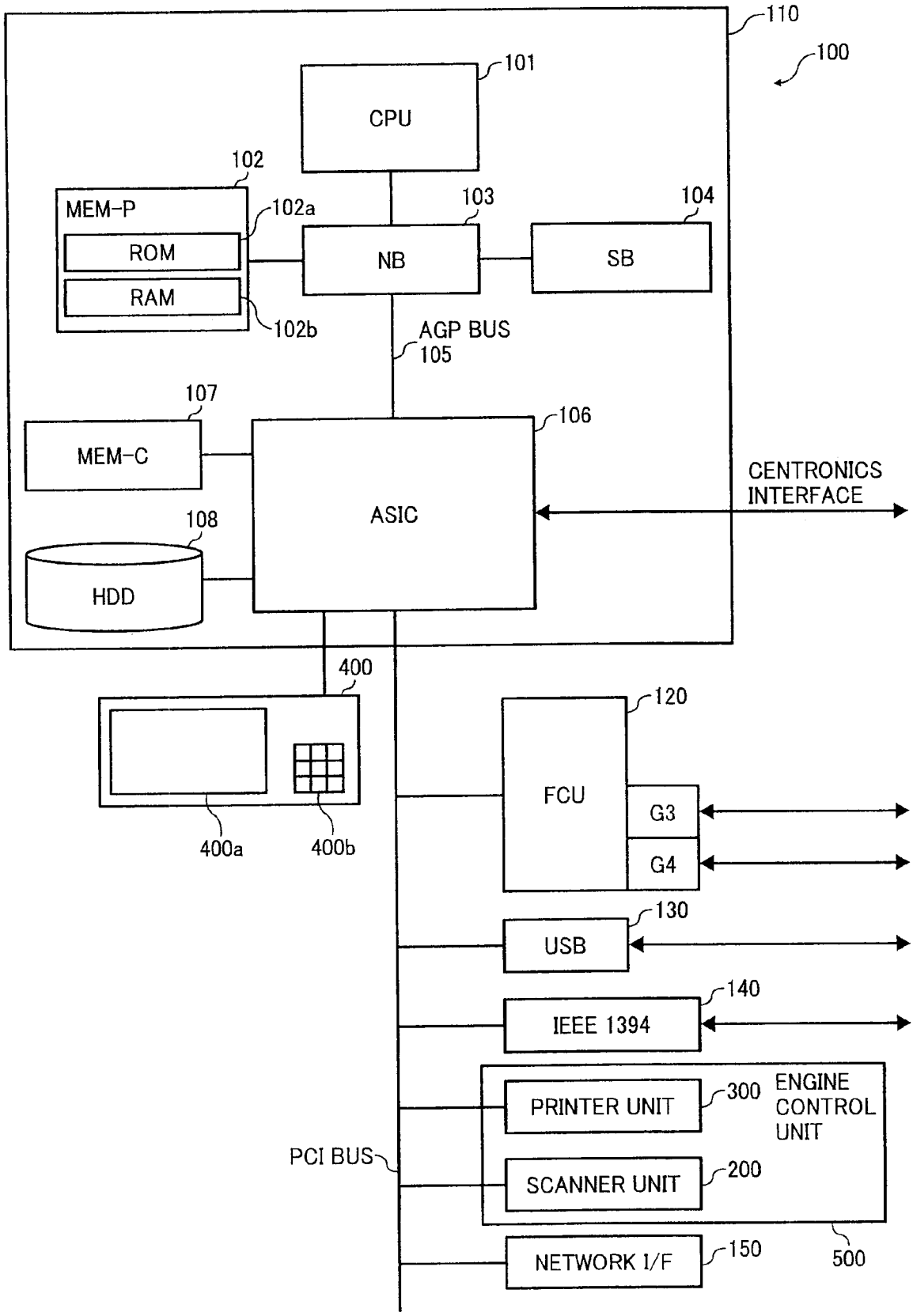
FIG. 3 is a block diagram that illustrates the hardware configuration of the color digital MFP.

Next, the hardware configuration of the color digital MFP 100 will be explained. FIG. 3 is a block diagram that illustrates the hardware configuration of the color digital MFP 100. As illustrated in FIG. 3, the color digital MFP 100 has a configuration in which a controller 110, the printer unit 300, and the scanner unit 200 are connected to one another via a Peripheral Component Interconnect (PCI) bus. The controller 110 is a controller that controls the entire color digital MFP 100 and controls drawings, communication, and input from the operating unit 400. The printer unit 300 or the scanner unit 200 includes an image processing section such as error diffusion, gamma transformation, or the like. The operating unit 400 includes an operation displaying unit 400*a* and a keyboard unit 400*b* that receives input keyed in by the operator. The operation displaying unit 400*a* displays, on a Liquid Crystal Display (LCD), original image information, or the like which is an original manuscript read by the scanner unit 200 and receives input from an operator via a touch panel.

The controller 110 includes a Central Processing Unit (CPU) 101 that is the main part of a computer, a system memory (MEM-P) 102, a north bridge (NB) 103, a south bridge (SB) 104, an ASIC (Application Specific Integrated Circuit) 106, a local memory (MEM-C) 107 that is a storage unit, and a hard disk drive (HDD) 108 that is a storage unit and has a configuration such that the NB 103 is coupled to the ASIC 106 via an Accelerated Graphics Port (AGP) bus 105. The MEM-P 102 further includes a read-only memory (ROM) 102*a* and a random access memory (RAM) 102*b*.

The CPU 101 performs the overall control of the color digital MFP 100 and includes a chip set which includes the NB 103, the MEM-P 102, and the SB 104, and the CPU 101 is connected to other devices via the chip set.

The NB 103 is a bridge to connect the CPU 101 with, the MEM-P 102, the SB 104, and the AGP bus 105 and includes a memory controller that controls reading from and writing to the MEM-P 102, a PCI master, and an AGP target.

The MEM-P 102 is a system memory used as a memory for storing programs and data, a memory for developing programs and data, a memory for drawing by a printer, or the like, and includes the ROM 102*a* and the RAM 102*b*. The ROM 102*a* is a read-only memory used as a memory for storing programs and data for controlling operations of the CPU 101, and the RAM 102*b* is a writable and readable memory used as a memory for developing programs and data, a memory for drawing by a printer, or the like.

The SB 104 is a bridge to connect the NB 103 with a PCI device, and a peripheral device. The SB 104 is connected to the NB 103 via the PCI bus, and a network interface (I/F) 150, or the like, is also connected to the PCI bus.

The ASIC 106 is an Integrated Circuit (IC) used for image processing that includes a hardware element for image processing, and has a function as a bridge to connect the AGP bus 105, the PCI bus, the HDD 108, and the MEM-C 107 each other. The ASIC 106 includes: a PCI target and an AGP master; an arbiter (ARB) that is the central core of the ASIC 106; a memory controller that controls the MEM-C 107; a plurality of Direct Memory Access Controllers (DMACs) that performs the rotation of image data, or the like, by using hardware logic; and a PCI unit that performs data transfer with the printer unit 300 or the scanner unit 200 via the PCI bus. A Fax Control Unit (FCU) 120, a Universal Serial Bus (USB) 130, an IEEE 1394 (Institute of Electrical and Electronics Engineers 1394) interface 140 are connected to the ASIC 106 via the PCI bus.

The MEM-C 107 is a local memory used as a copy image buffer or a code buffer, and the HDD 108 is storage for storing image data, storing programs for controlling operations of the CPU 101, storing font data, and storing forms.

The AGP bus 105 is a bus interface for a graphics accelerator card proposed for speeding up graphics processes and directly accesses the MEM-P 102 at a high throughput so that the speed of the graphics accelerator card is increased.

A program to be executed by the color digital MFP 100 according to the present embodiment is provided by being installed on a ROM, or the like, in advance. The program to be executed by the color digital MFP 100 according to the present embodiment may be provided by being stored in the form of a file that is installable and executable, in a recording medium readable by a computer, such as a CD-ROM, a flexible disk (FD), a CD-R, or a digital versatile disk (DVD).

Furthermore, the program to be executed by the color digital MFP 100 according to the present embodiment may be stored in a computer connected via a network such as the Internet and provided by being downloaded via the network. Moreover, the program to be executed by the color digital MFP 100 according to the present embodiment may be provided or distributed via a network such as the Internet.

Figure 4:
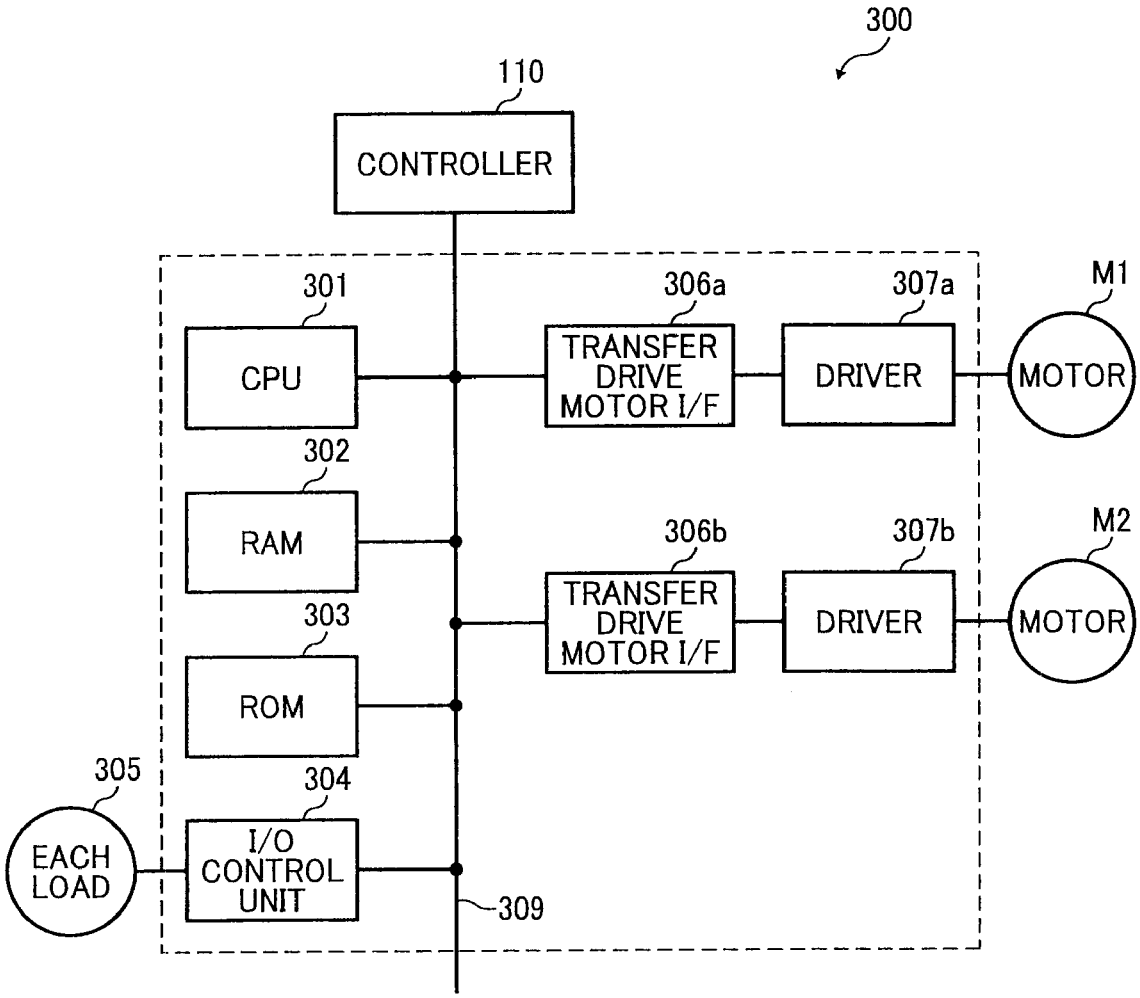
FIG. 4 is a block diagram that illustrates the hardware configuration of a printer unit.

FIG. 4 is a block diagram that illustrates the hardware configuration of the printer unit 300. As illustrated in FIG. 4, a control system of the printer unit 300 includes a CPU 301, a RAM 302, a ROM 303, an I/O control unit 304, a transfer drive motor I/F 306*a*, a driver 307*a*, a transfer drive motor I/F 306*b*, and a driver 307*b*.

The CPU 301 performs the overall control of the printer unit 300, including the control of reception of image data input from the controller 110 and transmission and reception of control commands.

The RAM 302 used for working, the ROM 303 for storing programs, and the I/O control unit 304 are connected to one another via a bus 309. The RAM 302 executes data read/write process and various operations of a motor, clutch, solenoid, sensor, or the like, for driving various loads 305 such as a contact/separate mechanism in response to an instruction from the CPU 301.

In response to a drive command from the CPU 301, the transfer drive motor I/F 306*a* outputs a command signal to the driver 307*a* so as to command the drive frequency of a drive pulse signal. A transfer-drive motor M1 is rotated in accordance with the drive frequency. The drive roller 17 illustrated in FIG. 2 is rotated in accordance with the rotation of the transfer-drive motor M1. Similarly, in response to a drive command from the CPU 301, the transfer-drive motor I/F 306*b* outputs a command signal to the driver 307*b* so as to command the drive frequency of a drive pulse signal. A transfer-drive motor M2 is rotated in accordance with the frequency. The drive roller 25 illustrated in FIG. 2 is rotated in accordance with the rotation of the transfer-drive motor M2.

The RAM 302 is used as a work area for executing programs stored in the ROM 303. Because the RAM 302 is a volatile memory, parameters, such as amplitude or phase value, to be used for a subsequent belt drive are stored in an undepicted nonvolatile memory such as an Electrically Erasable Programmable Read Only Memory (EEPROM). Data corresponding to one cycle of a belt is developed on the RAM 302 by using a sine function or an approximate equation when the power is turned on or the drive roller 17 is driven.

A program executed by the printer unit 300 according to the present embodiment has a module configuration including each of the units described later (a print control unit 51, an alignment control unit 52, an indirect transfer control unit 53, a direct transfer control unit 54, a secondary transfer control unit 55 (see FIG. 5), and the like). As an actual hardware, the CPU 301 reads out a program from the ROM 303 and executes the read program so that each of the units described above is loaded in a main storage, and then the print control unit 51, the alignment control unit 52, the indirect transfer control unit 53, the direct transfer control unit 54, the secondary transfer control unit 55, and the like are generated in the main storage.

Figure 5:
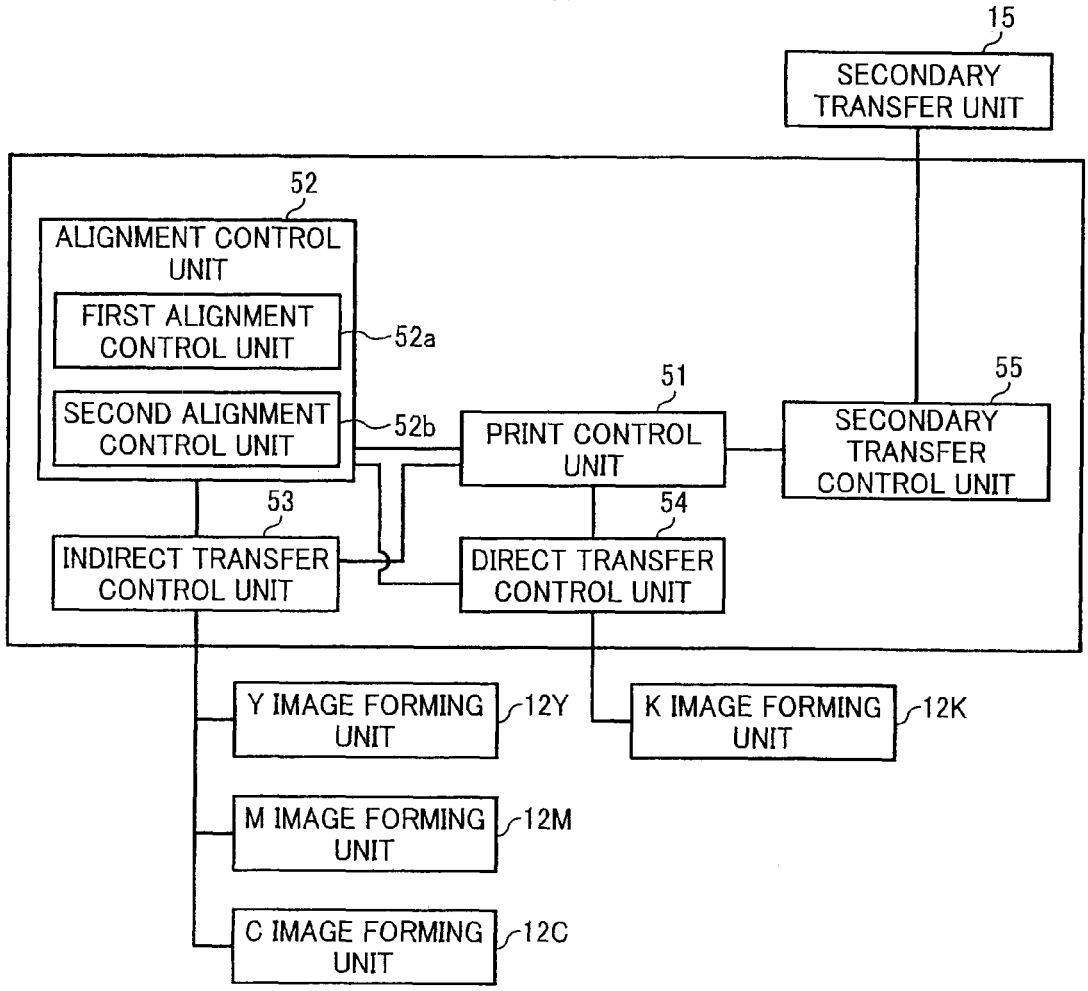
FIG. 5 is a block diagram that illustrates the functional configuration of the printer unit.

FIG. 5 is a block diagram that illustrates the functional configuration of the printer unit 300. The printer unit 300 mainly includes the print control unit 51, the alignment control unit 52, the indirect transfer control unit 53, the direct transfer control unit 54, and the secondary transfer control unit 55.

The print control unit 51 controls the entire system, i.e., the alignment control unit 52, the indirect transfer control unit 53, the direct transfer control unit 54, the secondary transfer control unit 55, and the like, in order to perform the full-color printing, the black-and-white printing, and an alignment control process. A control process performed by the print control unit 51 is described later with reference to FIGS. 11 to 14.

The alignment control unit 52 controls the indirect transfer control unit 53, the direct transfer control unit 54, the secondary transfer control unit 55, and the like in order to perform the alignment control process for respective images formed by the image forming units 12Y, 12M, 12K, and 12C. The alignment control unit 52 includes a first alignment control unit 52*a* and a second alignment control unit 52*b*.

Roughly speaking, by using color K formed by the image forming unit 12K on the direct transfer side as a reference color, the first alignment control unit 52*a* performs a first alignment control process which is an alignment of a C-color image formed by the image forming unit 12C on the indirect transfer side with respect to a K-color image.

Roughly speaking, by using color C that is aligned by the first alignment control as a reference color, the second alignment control unit 52*b* performs a second alignment control process which are alignments of the M-color and Y-color images with respect to the C-color image.

Figure 6:
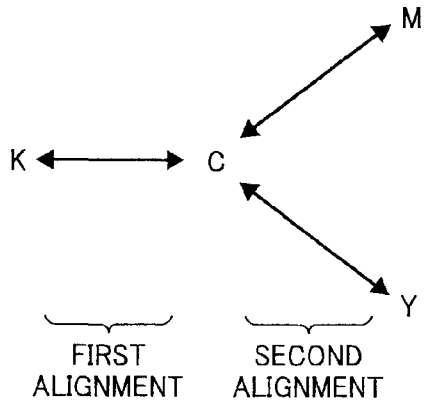
FIG. 6 is a diagram that illustrates the procedures of a first alignment and a second alignment.

Specifically, as illustrated in FIG. 6, the color digital MFP 100 according to the present embodiment is characterized in that the first alignment control unit 52*a* performs the first alignment to align a K-color image on the direct transfer side and a C-color image on the indirect transfer side and the second alignment control unit 52*b* performs the second alignment to align colors Y, M, and C on the indirect transfer side, whereby alignment among all of the colors is performed in two steps. Thus, it is possible to perform alignment among all colors for a K-color image, for which image formation is performed by a direct transfer method, and Y-, M-, and C-color images, for which image formation is performed by an indirect transfer method.

During the full-color printing under the control of the print control unit 51, the indirect transfer control unit 53 controls the image forming units 12Y, 12M, and 12C for colors Y, M, and C, and also controls the intermediate transfer belt 6. Then the indirect transfer control unit 53 forms images, which are to be transferred onto the transfer sheet P, on the photosensitive elements 1Y, 1M, and 1C. Toner images in colors Y, M, and C formed on the photosensitive elements 1Y, 1M, and 1C are superimposed on the intermediate transfer belt 6 by an indirect transfer method.

During the first alignment control process under the control of the first alignment control unit 52*a*, the indirect transfer control unit 53 controls the image forming unit 12C and the intermediate transfer belt 6 so as to form an alignment control pattern 13C (see FIG. 7) on the intermediate transfer belt 6.

During the second alignment control process under the control of the second alignment control unit 52*b*, the indirect transfer control unit 53 controls the image forming units 12Y, 12M, and 12C for colors Y, M, and C and the intermediate transfer belt 6 so as to form alignment control patterns 13Y, 13M, and 13C (see FIG. 10) for the alignment control process on the intermediate transfer belt 6.

During the full-color printing and the black-and-white printing under the control of the print control unit 51, the direct transfer control unit 54 controls the image forming unit 12K for color K so as to form an image, which is to be transferred onto the transfer sheet P, on the photosensitive element 1K. A toner image in color K formed on the photosensitive element 1K is transferred and printed on the transfer sheet P by a direct transfer method at an area where the photosensitive element 1K and the follower roller 21K as a transfer unit are in contact with each other.

During the first alignment control process under the control of the first alignment control unit 52*a*, the direct transfer control unit 54 controls the image forming unit 12K and the transfer-sheet conveying belt 8 so as to form an alignment control pattern 13K (see FIG. 8) on the transfer-sheet conveying belt 8.

During the full-color printing under the control of the print control unit 51 and the first alignment control process under the control of the first alignment control unit 52*a*, the secondary transfer control unit 55 operates the secondary transfer roller 28 so as to arrange the secondary transfer roller 28 close to the intermediate transfer belt 6.

During the black-and-white printing under the control of the print control unit 51 and the second alignment control process under the control of the second alignment control unit 52*b*, the secondary transfer control unit 55 operates the secondary transfer roller 28 so as to separate the secondary transfer roller 28 from the intermediate transfer belt 6 because there is no need to transfer toner images in colors Y, M, and C onto the transfer sheet P or the transfer-sheet conveying belt 8.

Next, the control of the first alignment control unit 52*a* in the first alignment control process described above will be explained in detail with reference to FIGS. 7 to 9.

First, the first alignment control unit 52*a* causes the indirect transfer control unit 53 and the image forming unit 12C to form the alignment control pattern 13C on the intermediate transfer belt 6. FIG. 7 is a plan view that illustrates an example of the alignment control pattern 13C formed on the intermediate transfer belt 6 by the photosensitive element 10.

Figure 7:
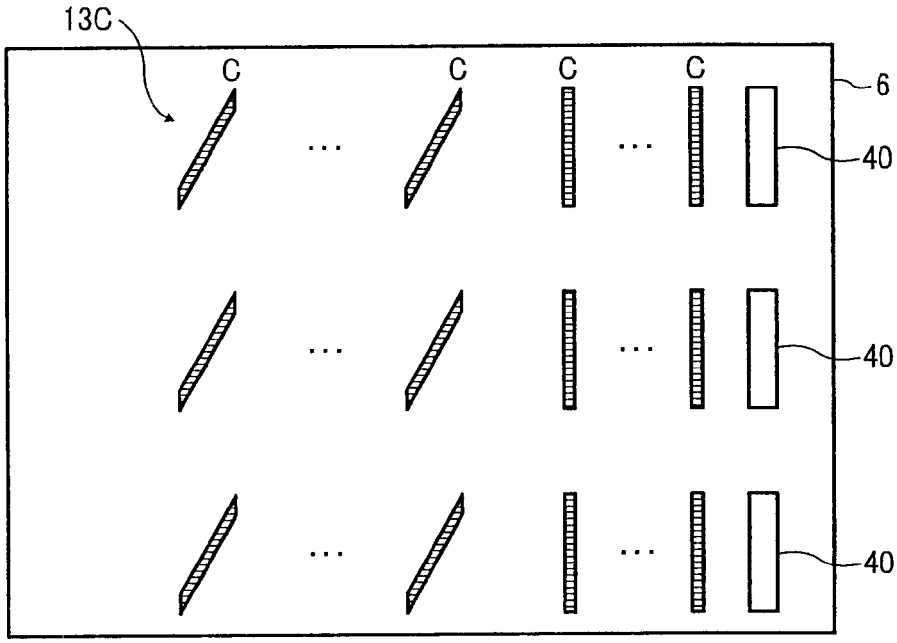
FIG. 7 is a plan view that illustrates an example of an alignment control pattern for color C formed on the intermediate transfer belt.
Figure 8:
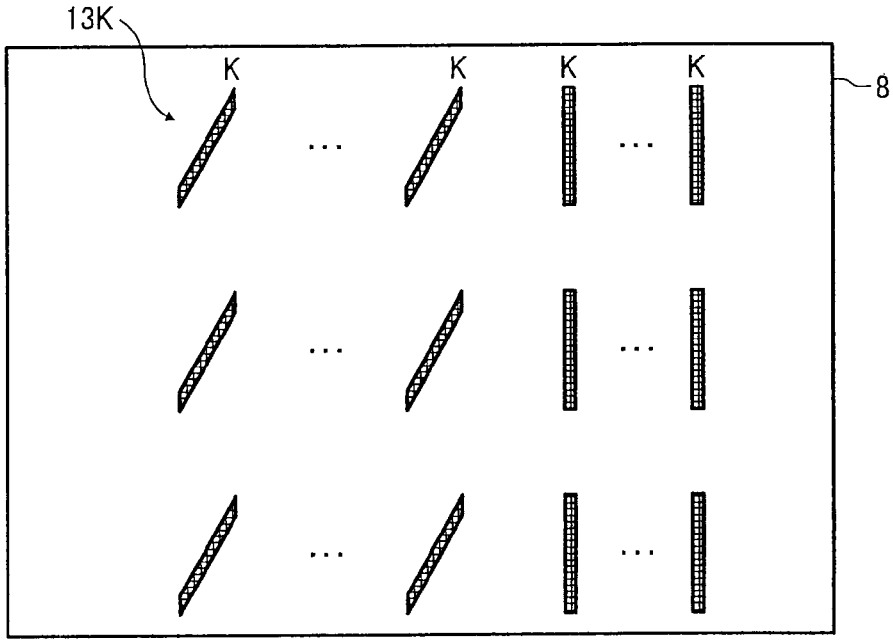
FIG. 8 is a plan view that illustrates an example of an alignment control pattern for color K formed on a transfer-sheet conveying belt.

As illustrated in FIG. 7, the alignment control pattern 13C is obtained by arranging a parallel line pattern and a diagonal line pattern at a certain interval in the sub-scanning direction.

The alignment control pattern 13C is repeatedly formed along the conveying direction of the intermediate transfer belt 6. In order to reduce the effect of errors by increasing the number of samples, a plurality of alignment control patterns 13 are output at positions corresponding to the pattern detection sensors 40 as illustrated in FIG. 7.

The first alignment control unit 52*a* causes the direct transfer control unit 54 and the image forming unit 12K to form the alignment control pattern 13K on the transfer-sheet conveying belt 8. FIG. 8 is a plan view that illustrates an example of the alignment control pattern 13K formed on the transfer-sheet conveying belt 8 by the photosensitive element 1K. The alignment control pattern 13K is formed in a similar pattern as the alignment control pattern 13C and is repeatedly formed along the conveying direction of the transfer-sheet conveying belt 8.

Then, the first alignment control unit 52*a* causes the secondary transfer control unit 55 to bring the intermediate transfer belt 6 and the transfer-sheet conveying belt 8 into contact with each other so that the alignment control pattern 13K formed on the transfer-sheet conveying belt 8 is transferred onto the intermediate transfer belt 6 and superimposed on the alignment control pattern 13C formed on the intermediate transfer belt 6. FIG. 9 is a diagram that illustrates the alignment control patterns 13C and 13K formed on the intermediate transfer belt 6 during the first alignment control process.

The first alignment control unit 52*a* is characterized in that the first alignment control process is performed by using a C-color image formed by the image forming unit 12C that is located closest to the secondary transfer unit 15 in the conveying direction of the intermediate transfer belt 6 among the image forming units 12Y, 12M, and 12C on the indirect transfer side.

Thus, when the alignment control pattern 13C for color C and the alignment control pattern 13K for color K are combined, the moving distance of the intermediate transfer belt 6 is shortest from when the alignment control pattern 13C for color C is formed on the intermediate transfer belt 6 to when the alignment control pattern 13K on the transfer-sheet conveying belt 8 is transferred onto the intermediate transfer belt 6. Therefore, it is possible to produce advantages such that the time required for combining the alignment control patterns 13K and 13C is shortest and the time required for alignment is shortened.

The first alignment control unit 52*a* then causes the pattern detection sensor 40 to detect the alignment control patterns 13K and 13C in the combined pattern of the alignment control patterns 13K and 13C formed on the intermediate transfer belt 6 as described above. Further, the first alignment control unit 52*a* calculates a main-scanning shift amount and a sub-scanning shift amount by using the detected alignment control patterns 13K and 13C.

First, with respect to the alignment control patterns 13K and 13C, the first alignment control unit 52*a* measures, by using a timer function of the CPU 101, the time from when a vertical line is detected by the pattern detection sensor 40 to when a diagonal line formed in the same color as the vertical line is detected and calculates intervals ΔSk and ΔSc (see FIG. 9) between the vertical line and the diagonal line using the measured time. The first alignment control unit 52*a* compares the calculated intervals ΔSk and ΔSc with respective reference values previously stored, thereby calculating the misalignment amount in the main scanning direction and the correction value.

With respect to the alignment control patterns 13K and 13C, the first alignment control unit 52*a* measures, by using the timer function of the CPU 101, the time from when the alignment control pattern 13K for color K as a reference color is detected by the pattern detection sensor 40 to when the alignment control pattern 13C for color C is detected and calculates an interval ΔFc between the alignment control patterns 13K and 13C using the measured time. The first alignment control unit 52*a* compares the calculated interval ΔFc with a reference value previously stored, thereby calculating the misalignment amount in the sub-scanning direction and the correction value.

The first alignment control unit 52*a* adjusts main/sub-scanning positions or skew in accordance with the correction values and corrects the positions of images formed by the image forming units 12K and 12C.

Next, the control process performed by the second alignment control unit 52*b* in the second alignment control process will be explained in detail.

Figure 10:
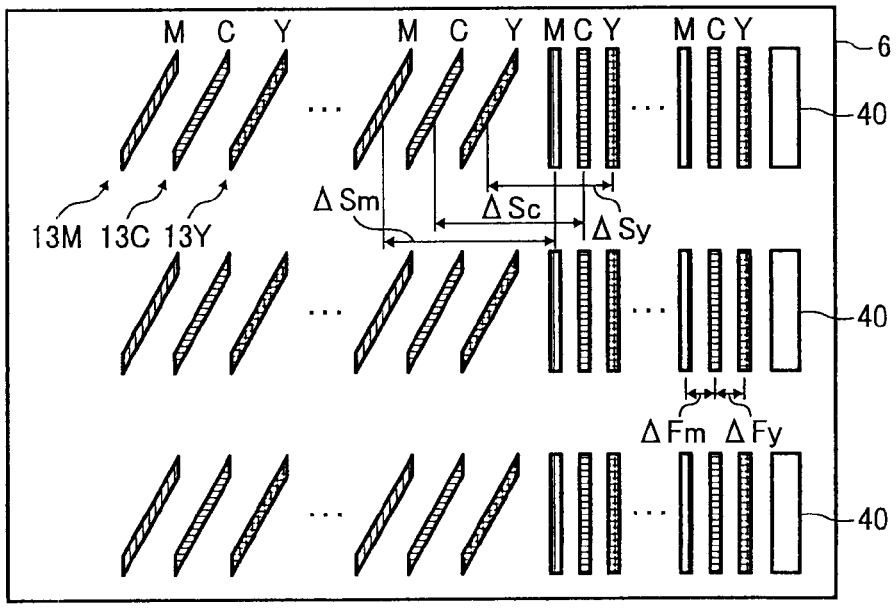
FIG. 10 is a plan view that illustrates an example of alignment control patterns for colors Y, M, and C combined on the intermediate transfer belt 6.

The second alignment control unit 52*b* causes the secondary transfer control unit 55 to separate the intermediate transfer belt 6 and the transfer-sheet conveying belt 8 from each other and causes the indirect transfer control unit 53 and the image forming units 12Y, 12M, and 12C to form the alignment control patterns 13Y, 13M, and 13C, respectively, on the intermediate transfer belt 6. FIG. 10 is a diagram that illustrates the alignment control patterns 13Y, 13M, and 13C formed on the intermediate transfer belt 6 by the photosensitive elements 1Y, 1M, and 1C during the second alignment control process.

As illustrated in FIG. 10, the alignment control patterns 13Y, 13M, and 13C are obtained by arranging three parallel patterns and three diagonal line patterns at a certain interval in the sub-scanning direction. The alignment control patterns 13Y, 13M, and 13C are repeatedly formed along the conveying direction of the intermediate transfer belt 6.

The second alignment control unit 52*b* then causes the pattern detection sensor 40 to detect the alignment control patterns 13Y, 13M, and 13C (see FIG. 10) formed on the intermediate transfer belt 6 so as to calculate the main-scanning shift amount and the sub-scanning shift amount.

First, with respect to the alignment control patterns 13Y, 13M, and 13C, the second alignment control unit 52*b* measures, by using the timer function of the CPU 101, the time from when a vertical line is detected by the pattern detection sensor 40 to when a diagonal line formed in the same color as the vertical line is detected and calculates intervals ΔSy, ΔSm, and ΔSc (see FIG. 10) between the vertical lines and the diagonal lines using the measured time. The second alignment control unit 52*b* compares the calculated intervals ΔSy, ΔSm, and ΔSc with respective reference values previously stored, thereby calculating the misalignment amount in the main scanning direction and the correction value.

The second alignment control unit 52*b* measures, by using color C, on which alignment has been performed in the first alignment control, as a reference color and by using the timer function of the CPU 101, the time from when the alignment control pattern 13C is detected by the pattern detection sensor 40 to when the alignment control patterns 13Y and 13M for Y and M are detected and calculates intervals ΔFy and ΔFm between the alignment control pattern 13Y and the alignment control pattern 13C and between the alignment control pattern 13M and the alignment control pattern 13C using the measured time. The second alignment control unit 52*b* compares the calculated intervals ΔFy and ΔFm with respective reference values for the intervals, thereby calculating the misalignment amount in the sub-scanning direction and the correction value.

The second alignment control unit 52*b* adjusts main/sub-scanning positions or skew in accordance with the correction values and corrects the positions of images formed by the image forming units 12Y, 12M, and 12C.

Next, the control performed by the print control unit 51 and the alignment control unit 52 during the full-color printing, the first alignment control and the second alignment control will be explained with reference to FIGS. 11 to 14.

First, the control performed by the print control unit 51 during the full-color printing will be explained. FIG. 11 is a diagram that illustrates the operations of the photosensitive element 1 and the secondary transfer roller 28 during the full-color printing.

During the full-color printing, the print control unit 51 causes the secondary transfer control unit 55 to arrange the secondary transfer roller 28 and the intermediate transfer belt 6 close to each other, causes the indirect transfer control unit 53 to control the image forming units 12Y, 12M, and 12C and the intermediate transfer belt 6 so as to perform a print process for colors Y, M, and C, and at the same time as this, causes the direct transfer control unit 54 to control the image forming unit 12K and the transfer-sheet conveying belt 8 so as to perform a print process for color K.

The term "contact" for the secondary transfer roller 28 illustrated in FIG. 11 means that the secondary transfer roller 28 is located close to the intermediate transfer belt 6 so that an image formed on the intermediate transfer belt 6 may be secondary-transferred onto the transfer-sheet conveying belt 8 or the transfer sheet P conveyed by the transfer-sheet conveying belt 8.

Specifically, the print control unit 51 causes an image area of the photosensitive element 1 (1Y, 1M, 1C, 1K), which is uniformly charged by the charging device 2 (2Y, 2M, 2C, 2K), to be irradiated with exposure light for each color emitted from the exposure device 5 and causes the developing device 3 (3Y, 3M, 3C, 3K) to form toner images. Afterwards, the print control unit 51 causes color toner images formed on the photosensitive elements 1Y, 1M, and 1C to be transferred onto the intermediate transfer belt 6 in synchronized timing, whereby superimposed toner images are formed. The print control unit 51 causes a black toner image formed on the photosensitive element 1K to be directly transferred onto the transfer sheet P conveyed by the transfer-sheet conveying belt 8 as a transfer conveying belt and then causes Y, M, and C toner images superimposed on the intermediate transfer belt 6 to be transferred onto the transfer sheet P. Thus, the transfer-sheet conveying belt 8 functions as a direct transfer belt in a transfer section for black toner images and functions as a secondary transfer belt in a transfer section for Y, M, and C toner images on the intermediate transfer belt 6.

Afterwards, the print control unit 51 causes the fixing device 10 to fix the toner images to the transfer sheet P, onto which the black toner image and the Y, M, and C toner images have been transferred in a superimposed manner, and then completes the print process for a full-color image. The print control unit 51 causes the transfer sheet P, for which fixing is complete, to be conveyed on a conveying path R1 (see FIG. 1) and causes a discharge roller pair 30 to discharge the transfer sheet P into a discharge tray 31 with the printed side face down so that the transfer sheet P is stacked. For a two-sided mode, the print control unit 51 causes the transfer sheet P to be guided to a conveying path R2 by using an undepicted switch claw, turned over by a duplex unit 34, and then conveyed to the registration roller pair 24 so that the transfer sheet P is delivered to a discharge path in the same manner as for a one-sided copy.

Next, the control performed by the print control unit 51 during the black-and-white printing will be explained. FIG. 12 is a diagram that illustrates the operations of the photosensitive element 1 and the secondary transfer roller 28 during the black-and-white printing.

During the black-and-white printing, the print control unit 51 causes the secondary transfer control unit 55 to separate the secondary transfer roller 28 and the intermediate transfer belt 6 from each other, causes the indirect transfer control unit 53 to terminate the print process for colors Y, M, and C, and causes the direct transfer control unit 54 to control the image forming unit 12K and the transfer-sheet conveying belt 8 so as to perform the print process for color K.

Specifically, the print control unit 51 causes an image area of the photosensitive element 1K to be irradiated with light from the exposure device 5 by using black image data and then causes the developing device 3K to form a toner image. The print control unit 51 causes the formed black toner image to be directly transferred onto the transfer sheet P conveyed by the transfer-sheet conveying belt 8, causes the fixing device 10 to fix the image, and then completes the print process for a monochrome image.

During formation of a monochrome image, the contact areas of the intermediate transfer belt 6 and the transfer-sheet conveying belt 8 are separated from each other as illustrated in FIG. 2A, and the image forming units 12 (12Y, 12M, 12C) for colors Y, M, and C and the intermediate transfer belt 6 are not operated. Thus, an advantage is produced such that longer operating lives of the image forming units 12 (12Y, 12M, 12C) for colors Y, M, and C and the intermediate transfer belt 6 may be achieved.

The term "separation" for the secondary transfer roller 28 illustrated in FIG. 10 means that the secondary transfer roller 28 is disposed away from the intermediate transfer belt 6.

Next, the control performed by the first alignment control unit 52*a* during the first alignment control will be explained. FIG. 13 is a diagram that illustrates the operations of the photosensitive element 1 and the secondary transfer roller 28 during the first alignment control.

As illustrated in FIG. 13, the first alignment control unit 52*a* causes the photosensitive element 10 so as to form the alignment control pattern 13C (see FIG. 7) for color C on the intermediate transfer belt 6, and, at the same time as this, operate the photosensitive element 1K so as to form the alignment control pattern 13K (see FIG. 8) for color K on the transfer-sheet conveying belt 8. Further, the first alignment control unit 52*a* causes the secondary transfer control unit 55 to make the secondary transfer roller 28 contact with the intermediate transfer belt 6 so as to transfer the alignment control pattern 13K formed on the transfer-sheet conveying belt 8 onto the intermediate transfer belt 6. The first alignment control unit 52*a* causes the pattern detection sensor 40 to detect the alignment control patterns 13K and 13C combined on the intermediate transfer belt 6 and calculates the misalignment amounts for colors K and C, thereby performing the first alignment control process. At this time, the photosensitive elements 1M and 1Y for M and Y, which are not used for the first alignment control, are run idle.

Next, the control performed by the second alignment control unit 52*b* during the second alignment control will be explained. FIG. 14 is a diagram that illustrates the operation of the photosensitive element 1 and the secondary transfer roller 28 during the second alignment control.

As illustrated in FIG. 14, the second alignment control unit 52*b* causes the indirect transfer control unit 53 to operate the photosensitive elements 1Y, 1M, and 1C so as to form the alignment control patterns 13Y, 13M, and 13C (see FIG. 10) for colors Y, M, C on the intermediate transfer belt 6. Further, the second alignment control unit 52*b* causes the pattern detection sensor 40 to detect the alignment control patterns 13Y, 13M, and 13C for colors Y, M, C combined on the intermediate transfer belt 6. Then the second alignment control unit 52*b* calculates the misalignment amounts for Y and M by using color C, on which the alignment has been performed in the first alignment control process, as a reference color, thereby performing the second alignment control. Then the second alignment control unit 52*b* causes the secondary transfer control unit 55 to separate the secondary transfer roller 28 and the intermediate transfer belt 6 from each other and causes the direct transfer control unit 54 to stop the operation of the photosensitive element 1K.

Next, an explanation is given of the control performed by the print control unit 51 and the second alignment control unit 52*b* when the black-and-white printing and the second alignment control are concurrently performed. FIG. 15 is a diagram that illustrates the operations of the photosensitive element 1 and the secondary transfer roller 28 when the black-and-white printing and the second alignment control are concurrently performed.

As illustrated in FIG. 15, the print control unit 51 causes the secondary transfer roller 28 of the secondary transfer unit 15 to be separated from the intermediate transfer belt in order to transfer only a K-color image onto the transfer sheet P and causes only the photosensitive element 1K to perform the print operation. Further, the print control unit 51 causes the second alignment control unit 52*b* to start the second alignment control. Specifically, the second alignment control unit 52*b* causes the indirect transfer control unit 53 to operate the photosensitive elements 1Y, 1M, and 1C so as to form the alignment control patterns 13Y, 13M, and 13C (see FIG. 10) for colors Y, M, and C on the intermediate transfer belt 6 and then performs the second alignment control process as described above.

Thus, the print control unit 51 can allow the print operation of the image forming unit 12K for color K during the black-and-white printing and the alignment control for the image forming units 12 (12Y, 12M, 12C) for colors Y, M, and C to be concurrently performed, whereby the alignment control process may be performed without increasing printing downtime.

Moreover, the contact areas of the intermediate transfer belt 6 and the transfer-sheet conveying belt 8 are separated from each other so that it is possible to prevent toner in colors Y, M, and C used for forming the alignment control patterns 13Y, 13M, and 13C from adhering to the transfer-sheet conveying belt 8 and adhering to the back surface of the transfer sheet P, thereby contaminating the back surface, when the black-and-white printing is concurrently performed.

Next, transition of the system control state by the print control unit 51 will be explained with reference to FIGS. 16 to 22.

FIG. 16 is a schematic diagram that illustrates an example of the first system control in which the print standby state and the first alignment are transited to the black-and-white printing and the second alignment, and then transited to the full-color printing.

As illustrated in FIG. 16, when the print standby state and the first alignment are to transit to the black-and-white printing and the second alignment, the print control unit 51 causes the secondary transfer control unit 55 to separate the secondary transfer roller 28 and the intermediate transfer belt 6 from each other when the first alignment is finished. Then, it issues an instruction to the second alignment control unit 52*b* to start the second alignment. Upon receiving the instruction, the second alignment control unit 52*b* controls the indirect transfer control unit 53 and controls the photosensitive elements 1Y, 1M, and 1C so as to form the alignment control patterns 13Y, 13M, and 13C on the intermediate transfer belt 6. As described above, the second alignment control unit 52*b* causes the pattern detection sensor 40 to detect the alignment control patterns 13Y, 13M, and 13C and calculates correction values, thereby correcting the positions of formed images in accordance with the correction values.

At the same time as the issue of the instruction to the second alignment control unit 52*b*, the print control unit 51 instructs the direct transfer control unit 54 to output an image so as to start the black-and-white printing. When the black-and-white printing is finished and the second alignment control process is also finished, the print control unit 51 starts a received full-color printing job. Specifically, the print control unit 51 makes the secondary transfer control unit 55 to cause the secondary transfer roller 28 and the intermediate transfer belt 6 contact each other, and the print control unit 51 instructs the indirect transfer control unit 53 and the direct transfer control unit 54 to output an image, thereby starting the full-color printing.

Thus, when the full-color printing is performed subsequent to the black-and-white printing, the second alignment and the black-and-white printing may be performed concurrently so that alignment for all of the colors Y, M, C, and K may be performed just before the full-color printing begins, whereby it is possible to reduce the amount of color shift due to the passage of time and the like during the full-color printing without significantly increasing print standby time.

FIG. 17 is a schematic diagram that illustrates an example of the second system control where the print standby state and the first alignment transit to the black-and-white printing and the second alignment, and then transit to the termination of the print process.

When the black-and-white printing is to be performed from the standby state, the print control unit 51 makes the secondary transfer roller 28 and the intermediate transfer belt 6 contact each other, and instructs the first alignment control unit 52*a* to start the first alignment control process. The first alignment control unit 52*a* instructs the direct transfer control unit 54 and the photosensitive element 1K to output the alignment control pattern 13K and, at the same time as this, instructs the indirect transfer control unit 53 and the photosensitive element 1C to output the alignment control pattern 13C. Further, the first alignment control unit 52*a* causes the secondary transfer control unit 55 to perform a proximity control so as to transfer the alignment control pattern 13K for color K onto the intermediate transfer belt 6. The first alignment control unit 52*a* causes the pattern detection sensor 40 to detect a composite pattern image in colors K and C formed on the intermediate transfer belt 6 and calculates the correction value as described above, thereby correcting the position of the image formed by the image forming unit 12C in accordance with the correction value.

When the first alignment is finished, the print control unit 51 causes the secondary transfer control unit 55 to separate the secondary transfer roller 28 and the intermediate transfer belt 6 from each other. The second alignment control unit 52*b* then instructs the photosensitive elements 1Y, 1M, and 1C to output the alignment control patterns 13Y, 13M, and 13C in order to perform the second alignment. The second alignment control unit 52*b* causes the pattern detection sensor 40 to detect the alignment control patterns 13Y, 13M, and 13C formed on the intermediate transfer belt 6 and calculates correction values, thereby correcting the positions of the images formed by the image forming units 12Y, 12M, and 12C in accordance with the correction values. At the same time as the second alignment, the print control unit 51 instructs the direct transfer control unit 54 to output an image, thereby starting the black-and-white printing. When the black-and-white printing and the second alignment are finished, the print control unit 51 causes the secondary transfer control unit 55 to separate the secondary transfer roller 28 and the intermediate transfer belt 6 from each other, an stop the image forming unit 12K.

Thus, in an example of the second system control, when the black-and-white printing is performed, the second alignment and the black-and-white printing may be concurrently performed so that it is possible to reduce the misalignment amount due to the passage of time and the like associated with the black-and-white printing.

FIG. 18 is a schematic diagram that illustrates an example of the third system control where the black-and-white printing and the second alignment transit to the print standby state and the first alignment, and then transit to the full-color printing. Although the print control unit 51 first performs the first alignment and then the second alignment in the examples of the first and the second system control, the print control unit 51 first performs the second alignment and subsequently performs the first alignment in the example of the third system control.

As illustrated in FIG. 18, the print control unit 51 first causes the second alignment control unit 52*b* to perform the second alignment at the same time as the black-and-white printing. In order to perform the second alignment during the black-and-white printing, the second alignment control unit 52*b* causes the indirect transfer control unit 53 and the photosensitive elements 1Y, 1M, and 1C to output the alignment control patterns 13Y, 13M, and 13C. The second alignment control unit 52*b* causes the pattern detection sensor 40 to detect the alignment control patterns 13Y, 13M, and 13C formed on the intermediate transfer belt 6 and detects the amount of color shift among colors Y, M, and C so as to calculate correction values. The second alignment control unit 52*b* corrects the positions of the images formed by the image forming units 12Y, 12M, and 12C in accordance with the correction values.

When the black-and-white printing and the second alignment are finished, in order to perform the first alignment, the print control unit 51 causes the secondary transfer control unit 55 to make the secondary transfer roller 28 and the intermediate transfer belt 6 contact each other, and the print control unit 51 instructs the first alignment control unit 52*a* to perform the first alignment control. The first alignment control unit 52*a* instructs the direct transfer control unit 54 and the photosensitive element 1K to output the alignment control pattern 13K and, at the same time as this, instructs the indirect transfer control unit 53 and the photosensitive element 10 to output the alignment control pattern 13C. The first alignment control unit 52*a* then causes the secondary transfer control unit 55 to transfer the alignment control pattern 13K for color K onto the intermediate transfer belt 6. The first alignment control unit 52*a* causes the pattern detection sensor 40 to detect a composite pattern image in colors K and C formed on the intermediate transfer belt 6 and detects the misalignment amount between colors K and C, thereby calculating the correction value.

In this case, the alignment among colors Y, M, and C has been completed; therefore, the state is such that there is no misalignment among colors Y, M, and C. Hence, a correction process is performed on color K by using color C as a reference. The second alignment control unit 52*b* corrects the position of the image formed by the image forming unit 12K in accordance with the correction value. When the first alignment is finished, the print control unit 51 then shifts to the full-color printing.

Thus, when the full-color printing is performed subsequent to the black-and-white printing, the second alignment and the black-and-white printing may be concurrently performed so that alignment among all of the colors Y, M, C, and K may be performed just before the full-color printing begins, whereby the color shift amount due to the passage of time and the like may be reduced during the full-color printing without significantly increasing print standby time.

FIG. 19 is a schematic diagram that illustrates an example of the fourth system control where, when the full-color printing is finished, the full-color printing transits to the first alignment and the second alignment.

When the full-color printing is finished, the print control unit 51 keeps the secondary transfer roller 28 and the intermediate transfer belt 6 contacted to each other. The first alignment control unit 52*a* instructs the direct transfer control unit 54 and the photosensitive element 1K to output the alignment control pattern 13K and, at the same time as this, instructs the indirect transfer control unit 53 and the photosensitive element 10 to output the alignment control pattern 13C. Further, the first alignment control unit 52*a* causes the secondary transfer control unit 55 to perform a proximity control, thereby transferring the alignment control pattern 13K for color K onto the intermediate transfer belt 6. The first alignment control unit 52*a* causes the pattern detection sensor 40 to detect the composite pattern image in colors K and C on the intermediate transfer belt 6 and detects the misalignment amount between colors K and C, thereby calculating the correction value for alignment. The first alignment control unit 52*a* corrects the position of the image formed by the image forming unit 12C in accordance with the correction value.

When the first alignment is finished, the print control unit 51 causes the secondary transfer control unit 55 to separate the secondary transfer roller 28 and the intermediate transfer belt 6 from each other and stops the photosensitive element 1K. The second alignment control unit 52*b* instructs the indirect transfer control unit 53 and the photosensitive elements 1Y, 1M, and 1C to output the alignment control patterns 13Y, 13M, and 13C in order to perform the second alignment. The second alignment control unit 52*b* causes the pattern detection sensor 40 to detect the alignment control patterns 13Y, 13M, and 13C formed on the intermediate transfer belt 6 and detects the misalignment amount among colors Y, M, and C, thereby calculating correction values for alignment. The second alignment control unit 52*b* corrects the positions of the images formed by the image forming units 12Y, 12M, and 12C in accordance with the correction values. When the second alignment is finished, the print control unit 51 stops the printer unit 300.

Thus, at the same time as performing alignment when the full-color printing is finished, the photosensitive element 1K for color K may be stopped at an early time so that it is possible to reduce the decrease in the operating life of the photosensitive element 1K for color K.

FIG. 20 is a schematic diagram that illustrates an example of a fifth system control where, when the full-color printing is finished, the first alignment control is performed, and the black-and-white printing and the second alignment are performed and then terminated.

When the full-color printing is finished, the print control unit 51 causes the indirect transfer control unit 53 to shift to the standby state, in which printing is not performed, and instructs the first alignment control unit 52*a* to perform the first alignment control. Specifically, the first alignment control unit 52*a* instructs the direct transfer control unit 54 and the photosensitive element 1K to output the alignment control pattern 13K and, at the same time as this, instructs the indirect transfer control unit 53 and the photosensitive element 1C to output the alignment control pattern 13C. Further, the first alignment control unit 52*a* causes the secondary transfer control unit 55 to transfer the alignment control pattern 13K for color K onto the intermediate transfer belt 6. The first alignment control unit 52*a* causes the pattern detection sensor 40 to detect the composite pattern image in colors K and C formed on the intermediate transfer belt 6 and detects the misalignment amount between colors K and C, thereby calculating the correction value for alignment. The first alignment control unit 52*a* then corrects the position of the image formed by the image forming unit 12C in accordance with the correction value.

When the first alignment is finished, the secondary transfer control unit 55 separates the secondary transfer roller 28 and the intermediate transfer belt 6 from each other. The print control unit 51 instructs the second alignment control unit 52*b* to start the second alignment. The second alignment control unit 52*b* instructs the indirect transfer control unit 53 and the photosensitive elements 1Y, 1M, and 1C to output the alignment control patterns 13Y, 13M, and 13C. The second alignment control unit 52*b* causes the pattern detection sensor 40 to detect the alignment control patterns 13Y, 13M, and 13C formed on the intermediate transfer belt 6 and detects the misalignment amount among colors Y, M, and C, thereby calculating correction values for alignment. The second alignment control unit 52*b* corrects the positions of the images formed by the image forming units 12Y, 12M, and 12C in accordance with the correction values.

At the same time as the second alignment, the print control unit 51 instructs the direct transfer control unit 54 to output an image, thereby starting the black-and-white printing. When the black-and-white printing is finished, the print control unit 51 causes the direct transfer control unit 54 to stop the operation of the image forming unit 12K. When the second alignment is finished, the print control unit 51 causes the indirect transfer control unit 53 to stop the operations of the image forming units 12Y, 12M, and 12C.

Thus, because the second alignment and the black-and-white printing may be concurrently performed, it is possible to perform alignment for all of the colors Y, M, C, and K without significantly increasing print standby time.

FIG. 21 is a schematic diagram that illustrates an example of the sixth system control where, after the first alignment is finished, the black-and-white printing is once terminated during the second alignment, and then the black-and-white printing is restarted.

As illustrated in FIG. 21, when the black-and-white printing is once terminated during the second alignment, the print control unit 51 causes the direct transfer control unit 54 to stop the operation of the image forming unit 12K. In this case, the print control unit 51 holds the secondary transfer roller 28 and the intermediate transfer belt 6 in a state where they are separated from each other. Afterwards, if a job for the black-and-white printing is received again and the black-and-white printing is restarted while the second alignment control process is being continuously performed, the print control unit 51 instructs the direct transfer control unit 54 to start printing by using the image forming unit 12K, thereby restarting the black-and-white printing.

Thus, because the secondary transfer roller 28 and the intermediate transfer belt 6 are held such that they are separated from each other during the second alignment control, the black-and-white printing may be performed intermittently and promptly during the second alignment and alignment may be performed for all of the colors while keeping the convenience of the black-and-white printing.

Figure 22:
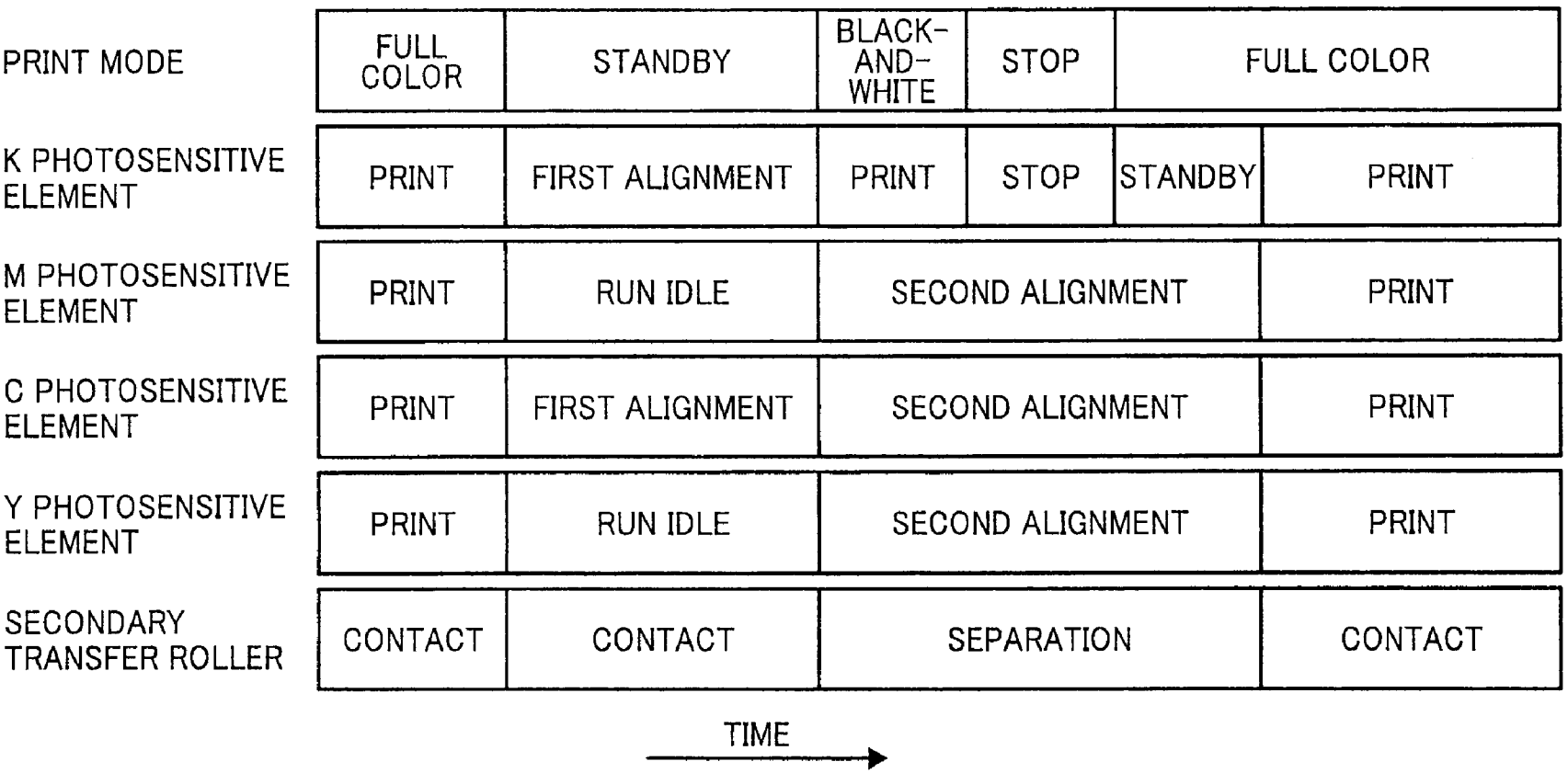
FIG. 22 is a schematic diagram that illustrates an example of a seventh system control.

FIG. 22 is a schematic diagram that illustrates an example of the seventh system control where, after the first alignment is finished, the black-and-white printing is once terminated during the second alignment and then the full-color printing is started.

As illustrated in FIG. 22, when the black-and-white printing is once terminated during the second alignment, the print control unit 51 causes the direct transfer control unit 54 to stop the operation of the image forming unit 12K. In this case, the print control unit 51 holds the secondary transfer roller 28 and the intermediate transfer belt 6 in a state where they are separated from each other.

Afterward, unlike the example of the sixth system control, even if a job for the full-color printing is received while the second alignment control process is continuously performed, because images need to be formed by indirect transfer by keeping the secondary transfer roller 28 and the intermediate transfer belt 6 contact to each other, the full-color printing may not be performed during the second alignment control process.

In this case, the print control unit 51 causes the direct transfer control unit 54 and the photosensitive element 1K to be in a standby state until the second alignment control process is finished. The standby state means a state where a print operation may be performed when preparation for the other photosensitive elements 1Y, 1M, and 1C is completed and means the same state as the stopped state in hardware or a state where the photosensitive element 1 is run idle. When the second alignment control process is finished, the print control unit 51 makes the secondary transfer control unit 55 to cause the secondary transfer roller 28 and the intermediate transfer belt 6 contact to each other, and to cause the direct transfer control unit 54, the indirect transfer control unit 53, and the image forming unit 12 to perform the full-color printing.

Thus, because the full-color printing may be performed after the second alignment control process is finished, alignment may be performed for all of the colors Y, M, C, and K just before the full-color printing begins without significantly increasing print standby time.

Thus, according to the present embodiment, the first alignment control unit 52*a* causes the secondary transfer control unit 55 to bring the transfer-sheet conveying belt 8 and the intermediate transfer belt 6 into contact with each other so that the alignment control pattern 13K for color K formed on the transfer-sheet conveying belt 8 is superimposed on the alignment control pattern 13C for color C formed on the intermediate transfer belt 6, whereby alignment is performed for colors C and K, furthermore, the second alignment control unit 52*b* causes the secondary transfer control unit 55 to separate the transfer-sheet conveying belt 8 and the intermediate transfer belt 6 from each other so as to perform alignment for colors Y, M, and C, whereby alignment may be performed for all colors, and, in addition, because the black-and-white printing process by the direct transfer control unit 54 and the second alignment control process may be concurrently performed, an advantage is produced such that alignment may be performed for all of the colors with respect to a K-color image transferred by a direct transfer method and Y-, M-, and C-color images transferred by an indirect transfer method while maintaining printing productivity.

In the above descriptions, during the first alignment control process, the first alignment control unit 52*a* transfers the alignment control pattern 13K formed on the transfer-sheet conveying belt 8 onto the intermediate transfer belt 6 on which the alignment control pattern 13C is formed and causes the pattern detection sensor 40 to detect the alignment control patterns 13K and 13C on the intermediate transfer belt 6; however, the present invention is not limited thereto.

Figure 23:
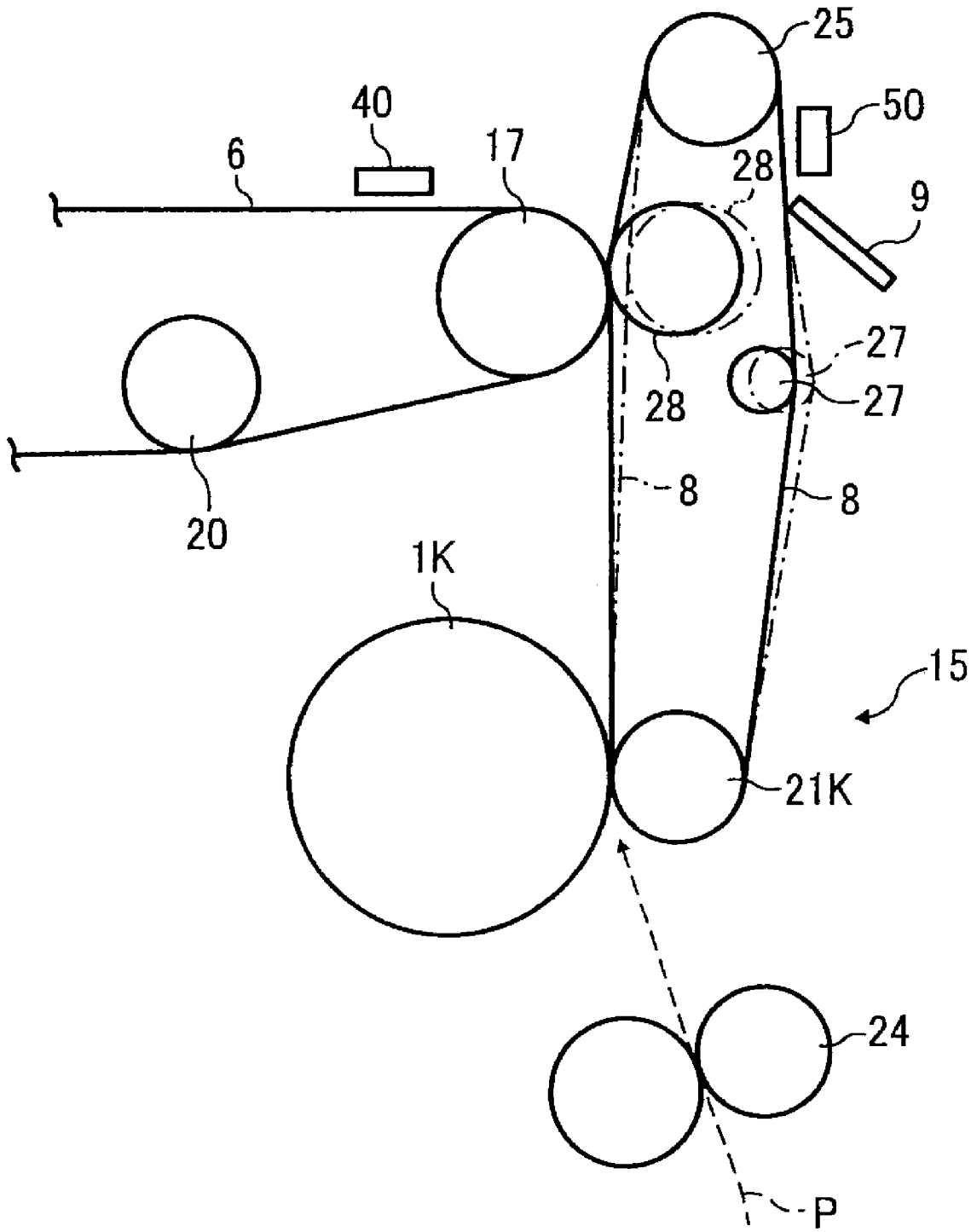
FIG. 23 is a schematic diagram that illustrates a pattern detection sensor that is located near the transfer-sheet conveying belt.

For example, as illustrated in FIG. 23, a configuration may be such that pattern detection sensors 50 that detect the alignment control patterns 13 formed on the transfer-sheet conveying belt 8 are located on the extreme left, the middle, and the extreme right in the width direction of the transfer-sheet conveying belt 8. In addition, during the first alignment control process, the first alignment control unit 52*a* may transfer the alignment control pattern 13C formed on the intermediate transfer belt 6 onto the transfer-sheet conveying belt 8 on which the alignment control pattern 13K is formed and cause the pattern detection sensor 50 to detect the alignment control patterns 13C and 13K formed on the transfer-sheet conveying belt.

Figure 9:
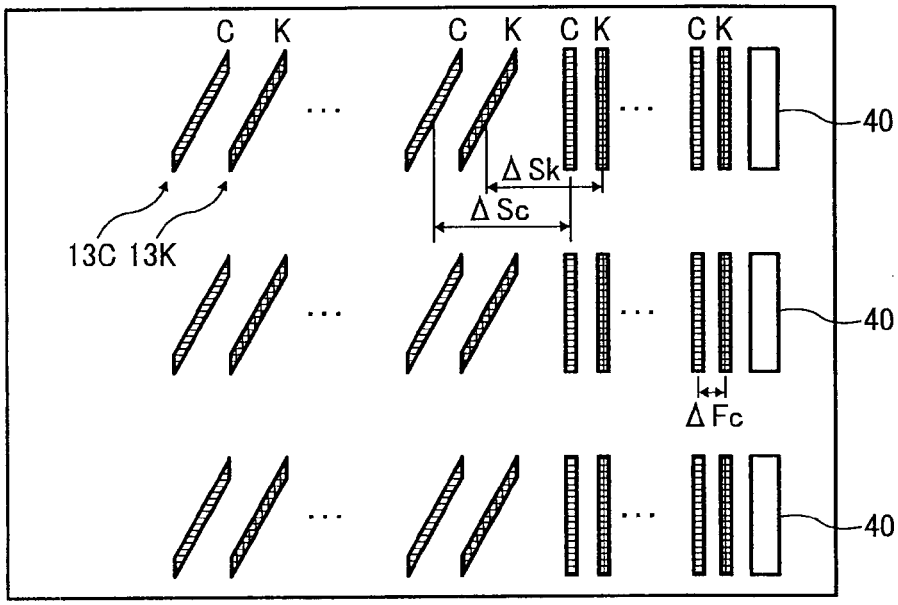
FIG. 9 is a plan view that illustrates an example of alignment control patterns for colors C and K combined on the intermediate transfer belt.

With such a configuration, if the alignment control pattern 13C for color C is transferred onto the transfer-sheet conveying belt 8 so that the alignment control pattern 13C is combined with the alignment control pattern 13K for color K, as illustrated in FIG. 9, it is possible to detect the alignment control patterns 13K and 13C for colors K and C using the pattern detection sensor 50.

According to the present invention, an advantage is produced such that alignment may be performed for all colors with respect to an image transferred by a direct transfer method and an image transferred by an indirect transfer method while maintaining printing productivity.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a direct transfer control unit that controls a single-color image forming unit and a direct transfer unit, wherein the direct transfer control unit is configured to transfer an image formed by the single-color image forming unit onto the direct transfer unit or a transfer sheet conveyed by the direct transfer unit;

an indirect transfer control unit that controls multicolor image forming units and an intermediate transfer unit and causes the multicolor image forming units to superimpose multicolor images on the intermediate transfer unit;

a secondary transfer control unit that controls proximity and separation between the direct transfer unit and the intermediate transfer unit;

a first alignment control unit that performs a first alignment control process by causing the secondary transfer control unit to perform the proximity control so as to transfer both an image formed on the direct transfer unit by the direct transfer control unit and an image formed on the intermediate transfer unit by the indirect transfer control unit onto at least one of the direct transfer unit and the intermediate transfer unit, wherein the first alignment control unit is configured to correct misalignment of each of the images in a main-scanning and a sub-scanning directions; and a second alignment control unit that performs a second alignment control process by causing the secondary transfer control unit to perform a separation control, wherein the second alignment control unit uses a position of a color image that has undergone the first alignment control process as a reference, wherein the second alignment control unit is configured to correct misalignment of a different color image formed on the intermediate transfer unit by the indirect transfer control unit in the main-scanning and sub-scanning directions.

2. The image forming apparatus according to claim 1, wherein an image that is formed by the indirect transfer control unit and corrected by the first alignment control unit is an image formed by any one of the image forming units for which a moving distance is the shortest, wherein the moving distance is a distance of the intermediate transfer unit from a position where an image is formed on the intermediate transfer unit to a position where the transfer is performed.

3. The image forming apparatus according to claim 1, wherein the first alignment control unit transfers an image formed on the direct transfer unit onto the intermediate transfer unit, and detects a misalignment amount of an image formed on the intermediate transfer unit in the main-scanning and sub-scanning directions by using a position of the image transferred onto the intermediate transfer unit as a reference.

4. The image forming apparatus according to claim 1, wherein the first alignment control unit transfers an image formed on the intermediate transfer unit onto the direct transfer unit, and detects a misalignment amount of the image transferred onto the direct transfer unit in the main and sub-scanning directions by using a position of an image formed on the direct transfer unit as a reference.

5. The image forming apparatus according to claim 1, further comprising a print control unit that controls:

the direct transfer control unit;

the indirect transfer control unit;

the secondary transfer control unit;

the first alignment control unit, and the second alignment control unit, wherein the print control unit concurrently performs an alignment control process and a print control process.

6. The image forming apparatus according to claim 5, wherein the print control unit concurrently causes the second alignment control process to be performed by the second alignment control unit and causes a print process to be performed so as to transfer an image formed by the image forming unit controlled by the direct transfer control unit onto the transfer sheet that is in a process of being conveyed.

7. The image forming apparatus according to claim 5, wherein the print control unit first causes the second alignment control unit to perform the second alignment control process, causes the secondary transfer control unit to perform the proximity control, and then causes the first alignment control unit to perform the first alignment control process, and the first alignment control unit performs the first alignment control process by using an image in one of colors for which the second alignment control process has been performed as a reference.

8. The image forming apparatus according to claim 5, wherein, when printing is not being performed by the direct transfer control unit or the indirect transfer control unit, the print control unit causes the secondary transfer control unit to perform the proximity control and causes the first alignment control unit to start the first alignment control process.

9. The image forming apparatus according to claim 5, wherein, when printing is not being performed by the direct transfer control unit or the indirect transfer control unit, the print control unit causes the secondary transfer control unit to perform the separation control and causes the second alignment control unit to start the second alignment control process.

10. The image forming apparatus according to claim 5, wherein, when printing is finished by the direct transfer control unit or the indirect transfer control unit, the print control unit causes the first alignment control unit to start the first alignment control process.

11. The image forming apparatus according to claim 5, wherein, when the first alignment control process is finished, the print control unit concurrently causes the secondary transfer control unit to perform the separation control, causes the second alignment control unit to perform the second alignment control process, and stops the image forming unit that is controlled by the direct transfer control unit.

12. The image forming apparatus according to claim 5, wherein, when the printing is to be started by the indirect transfer control unit, the print control unit causes the indirect transfer control unit to be in a standby state until the second alignment control process is finished.

13. The image forming apparatus according to claim 1, wherein an image formed by the image forming unit that is controlled by the direct transfer control unit has a block color.

14. An image forming method performed by an image forming apparatus that includes a direct transfer control unit that transfers an image formed by an image forming unit onto a direct transfer unit or a transfer sheet conveyed by the direct transfer unit;

an indirect transfer control unit that causes multicolor image forming units to superimpose multicolor images on the intermediate transfer unit and then transfers the multicolor images onto the transfer sheet; and a secondary transfer control unit that controls proximity and separation between the direct transfer unit and the intermediate transfer unit, the image forming apparatus including a control unit and a storage unit, and the image forming method performed by the control unit comprising:

performing, by a first alignment control unit, a first alignment control process by causing the secondary transfer control unit to perform the proximity control so as to transfer an image formed on the direct transfer unit by the direct transfer control unit and an image formed on the intermediate transfer unit by the indirect transfer control unit onto at least one of the direct transfer unit and the intermediate transfer unit and correcting misalignment of each of the images in main and sub-scanning directions; and performing, by a second alignment control unit, a second alignment control process by causing the secondary transfer control unit to perform a separation control and, by using a position of a color image that has undergone the first alignment control process as a reference, correcting misalignment of a different color image formed on the intermediate transfer unit by the indirect transfer control unit in the main and sub-scanning directions.

15. A non-transitory computer-readable storage medium that stores a program that causes a computer to function as:

a direct transfer control unit that controls a single-color image forming unit and a direct transfer unit so as to transfer an image formed by the single-color image forming unit onto the direct transfer unit or a transfer sheet conveyed by the direct transfer unit;

an indirect transfer control unit that controls multicolor image forming units and an intermediate transfer unit and causes the multicolor image forming units to superimpose multicolor images on the intermediate transfer unit;

a secondary transfer control unit that controls contact and separation between the direct transfer unit and the intermediate transfer unit;

a first alignment control unit that performs a first alignment control process by causing the secondary transfer control unit to perform the proximity control so as to transfer both an image formed on the direct transfer unit by the direct transfer control unit and an image formed on the intermediate transfer unit by the indirect transfer control unit onto at least one of the direct transfer unit and the intermediate transfer unit and correcting misalignment of each of the images in main and sub-scanning directions; and a second alignment control unit that performs a second alignment control process by causing the secondary transfer control unit to perform a separation control and, by using a position of a color image that has undergone the first alignment control process as a reference, correcting misalignment of a different color image formed on the intermediate transfer unit by the indirect transfer control unit in the main and sub-scanning directions.

* * * * *